US006044686A

United States Patent [19]

Dischler

[11] Patent Number: 6,044,686

[45] Date of Patent: Apr. 4, 2000

[54] COMPRESSION TOOL FOR COMPRESSION MOLDING DIE

[76] Inventor: Helmut Dischler, Droste-Holshoff-Strasse 9, D-41464, Neuss, Germany

[21] Appl. No.: 09/004,921

[22] Filed: Jan. 9, 1998

Related U.S. Application Data

[63] Continuation-in-part of application No. 08/591,081, Jan. 25, 1996, abandoned, which is a continuation-in-part of application No. 08/422,605, Apr. 12, 1995, Pat. No. 5,598,732, which is a continuation of application No. 08/215,969, Mar. 17, 1994, abandoned, which is a continuation of application No. 07/914,237, Jul. 17, 1992, abandoned, which is a continuation-in-part of application No. 07/679,943, Apr. 3, 1991, Pat. No. 5,148,698.

[30] Foreign Application Priority Data

Apr. 20, 1990 [DE] Germany ..... 4011822

[51] Int. Cl.[7] ..... B21D 39/04

[52] U.S. Cl. ..... 72/402; 72/452.1; 29/237

[58] Field of Search ..... 72/402, 416, 453.16, 72/453.15, 292, 452.2, 452.1; 29/237

[56] References Cited

U.S. PATENT DOCUMENTS

| | | | |
|---|---|---|---|
| 51,636 | 12/1865 | Weitman | 72/292 |
| 639,277 | 12/1899 | Pangle | 72/292 |
| 701,549 | 6/1902 | Deering . | |
| 1,353,719 | 9/1920 | Buresch . | |
| 1,818,435 | 8/1931 | Smith et al. | 153/48 |
| 2,182,663 | 12/1939 | Eby et al. | 140/113 |
| 2,211,008 | 8/1940 | Goldberg | 153/1 |
| 2,326,709 | 8/1943 | Watson | 140/55 |
| 2,335,591 | 11/1943 | Hansell | 72/292 |
| 2,381,748 | 8/1945 | Howe | 29/148 |
| 2,557,202 | 6/1951 | Raymond et al. | 269/287 |
| 2,674,966 | 4/1954 | Morris | 72/292 |
| 2,766,631 | 10/1956 | Van Sittert | 72/453.16 |
| 2,800,867 | 7/1957 | Smith | 113/102 |
| 2,871,812 | 2/1959 | Pederson | 72/292 |
| 2,973,024 | 2/1961 | Merriman | 153/1 |
| 3,176,495 | 4/1965 | Zane | 72/402 |
| 3,203,221 | 8/1965 | Conner | 72/410 |
| 3,220,072 | 11/1965 | Moss | 24/20 |
| 3,276,238 | 10/1966 | Erdmann | 72/410 |
| 3,335,598 | 8/1967 | Jessen | 72/402 |
| 3,555,875 | 1/1971 | Clark | 72/292 |
| 3,568,495 | 3/1971 | Duffield | 72/402 |
| 3,575,036 | 4/1971 | Hoffman | 72/402 |
| 3,662,450 | 5/1972 | Kish et al. | 29/237 |
| 3,688,553 | 9/1972 | Demler, Sr. | 72/410 |
| 3,695,087 | 10/1972 | Tuberman | 72/402 |
| 3,756,064 | 9/1973 | Erdmann | 72/410 |
| 3,803,699 | 4/1974 | Rizzo | 29/237 |
| 3,823,597 | 7/1974 | Hanback et al. | 72/402 |

(List continued on next page.)

FOREIGN PATENT DOCUMENTS

| | | | |
|---|---|---|---|
| 1426844 | 3/1965 | France . | |
| 2086319 | 12/1971 | France . | |
| 1187870 | 10/1965 | Germany . | |
| 1198147 | 4/1966 | Germany . | |
| 1907956 | 10/1969 | Germany . | |
| 2458172 | 5/1976 | Germany . | |
| 2511942 | 9/1976 | Germany . | |
| 2136782 | 12/1982 | Germany . | |
| 3423283 | 1/1986 | Germany . | |
| 3513129 | 10/1986 | Germany . | |
| 54773 | 1/1943 | Netherlands | 72/396 |
| 31177 | 4/1913 | Switzerland | 72/292 |
| 1306633 | 5/1984 | U.S.S.R. . | |

*Primary Examiner*—Daniel C. Crane
*Attorney, Agent, or Firm*—Liniak, Berenato, Longacre & White, LLC

[57] ABSTRACT

A pressing device comprises a press ring having at least three pivotally interconnected compression jaws. The press ring has a first open configuration, and a second closed configuration. A coupling element extends from each of two jaws for operable connection to a closing device. The closing device shifts the press ring between the configurations, and includes two oppositely disposed pivotal levers. A drive device is operably engageable with each of the levers, for pivoting the levers and thereby causing the ring to be shifted between the configurations.

23 Claims, 12 Drawing Sheets

U.S. PATENT DOCUMENTS

| | | | |
|---|---|---|---|
| 3,848,451 | 11/1974 | Allin | 72/402 |
| 4,183,120 | 1/1980 | Thorne | 24/16 |
| 4,528,740 | 7/1985 | Sassak | 29/516 |
| 4,558,584 | 12/1985 | Myers | 72/453.16 |
| 4,604,890 | 8/1986 | Martin | 72/453.16 |
| 4,782,577 | 11/1988 | Bahler | 29/525.1 |
| 4,890,473 | 1/1990 | Westerman et al. | 72/402 |
| 4,989,443 | 2/1991 | Sawdon | 72/402 |
| 5,007,280 | 4/1991 | Quinn et al. | 72/402 |
| 5,148,698 | 9/1992 | Dischler | 72/410 |
| 5,209,100 | 5/1993 | Dischler | 72/410 |

COMPRESSION TOOL FOR COMPRESSION MOLDING DIE

CROSS-REFERENCE TO RELATED APPLICATIONS

This is a continuation-in-part of application Ser. No. 08/591,081, filed Jan. 25, 1996, now abandoned, which is a continuation-in-part of application Ser. No. 08/422,605 filed Apr. 12, 1995, now U.S. Pat. No. 5,598,732, which is a continuation of Ser. No. 08/215,969 filed Mar. 17, 1994, now abandoned, which is a continuation of Ser. No. 07/914, 237 filed Jul. 17, 1992, now abandoned, which is a continuation-in-part of Ser. No. 07/679,943 filed Apr. 3, 1991, now U.S. Pat. No. 5,148,698.

BACKGROUND OF THE INVENTION

The invention concerns a compression tool, in particular for joining tubular workpieces, with more than two arcuate compression jaws so movable relative to each other that they can open in order to be placed on the workpiece and that they complement one another into a closed compression space toward the end of compression, and also comprising at least one drive system to move the compression jaws towards the workpiece for compression therebetween.

Metal coupling sleeves, preferably steel, and plastically deforming, are employed to join pipe ends. The sleeve inside diameter exceeds the outside diameter of the pipe ends to be joined by an amount such that when being radially compressed, they remain deformed until coming to rest against the outside of the pipe ends. As disclosed by the German Patent No. 1,187,870, such coupling sleeves additionally may comprise an annular groove near each end which receives an elastic sealing ring.

Radial compression may be implemented by compression tools, such as illustratively known from the German Patent No. 21 36 782. This compression tool comprises two clamping jaws, each with two arms and at least one clamping jaw being pivotally supported on the compression tool. The compression jaws comprise compression surfaces forming arcs of circle of equal radii, enclosing a compression space. Instead of being arcs of circle, the compression surfaces also may be contoured, for instance to form a polygonal or oval compression space.

The arms of the compression jaws away from the compression space can be spread apart against the force of a spring, whereby the compression jaws move relative to each other in the region of the compression space. The spreading apart takes place by means of adjacent and abutting pressure rollers which are jointly moved by a drive system comprising an operational cylinder between the arms for thereby causing pivoting of the compression jaws.

The German Offenlegungsschrift 34 23 283 describes a compression tool of this type. In that compression tool, there are two compression jaws each pivotally supported on a drive lever which is in turn pivotally guided on the compression tool. The drive levers comprise opposite arms which can be spread apart by pressure rollers moved by an operational cylinder into the gap between the arms. Moreover, the compression jaws are guided in slide means so that, upon the drive levers being pivoted into the open position, they will be pivoted up about their linkages at the drive whereby a wide, tong-like aperture is created between the compression jaws, facilitating the seating of the pipe ends to be joined, or of a coupling sleeve.

When pivoting the drive levers in the reverse direction, the clamping jaws again are so pivoted so that the mid-perpendiculars to their arcs of circle approximately coincide, and upon further pivoting motion of the drive levers the clamping jaws are displaced relative to one another in parallel manner. The clamping jaws are further displaced during compression until at the end of this compression they enclose a circular surface, whereby they have deformed the pipe ends or the coupling sleeve by a corresponding reduction in diameter.

This compression tool has been found practically useful, provided that a comparatively modest reduction in diameter or squeeze depth is required. Where the squeeze depths are more substantial—which shall be the case when the pipe connection must withstand higher internal pressures, more than two compression jaws must be provided to prevent beads from being formed between the end faces of the compression jaws, or else complete closure will not take place. Such compression tools are known for instance from the German Offenlegungsschriften 21 28 782; 35 13 129; and the German Auslegeschriften 25 11 942 and 19 07 956. All the compression tools described therein share in common the feature that all the clamping jaws are displaceable and are guided in the radial direction. This entails complex guide means and drive systems, with the result that the compression tools become heavy and hard to handle, and also expensive.

SUMMARY OF THE INVENTION

The object of the invention is to design a compression tool of the initially cited kind that, in spite of the presence of more than two compression jaws, can be as simple as possible and therefore easily handled and economical to manufacture.

The problem is solved by the invention in that one of the compression jaws is a rest which can be placed on the workpiece, and the other compression jaws are displaceable by means of the drive system(s) and are guided so that during compression they always move toward the center of the compression space achieved by the compression tool when in the closed state. Appropriately, the compression jaws are displaced relative to each other so that their adjacent and opposite end faces are equal distances apart at the beginning of compression.

The compression tool of the invention is achieved by its simple design having one of the compression jaws being a rest and therefore not requiring a guide or drive. The remaining compression jaws are guided and driven so that during compression they move in very specific directions, namely toward the center of the compression chamber achieved by the compression tool when in the closed state. This is an important condition so that equal forces act from all sides on the workpiece.

In one embodiment of the invention, the compression jaws evince equal arcs of circle at their periphery, so that any gaps between the opposite end faces of the compression jaws are evenly distributed over the periphery.

Where three compression jaws are present, the directions of motion of the two displaceable compression jaws should subtend between them an angle of 60° which is symmetrical to the mid-perpendicular of the rest and which angle opens away from this rest. Where four compression jaws are involved, the directions of motion of the two compression jaws adjacent to the rest subtend an angle of 90° during compression, this 90° angle being symmetrical to the mid-perpendicular of the rest and opening away from it.

In a further feature of the invention, the rest is designed as a rest-yoke at the free end of the compression tool, and pivotally supported on one side while being detachable or lockable at the opposite side. This rest-yoke can be pivoted open when the compression tool is to be placed on the pipe ends to be joined, i.e. on the coupling sleeve. After being pivoted back and locked, the displaceable compression jaws can then be moved by the drive system toward the rest.

In a further embodiment of the invention, the displaceable compression jaws on one hand rest against the guide means which determines the displacement directions, and on the other hand rest against a compression force which is displaceable toward the rest and connected to the drive system (s) and which supports in displaceable manner the compression jaws adjacent to the rest. It is possible in this respect to install a further compression jaw at, or connect it with the compression force between, the compression jaws so that the jaws are displaceable relative to this force, where this further jaw is opposite the rest. The compression force is part of the drive system and illustratively may be a hydraulic actuator or be connected to such. Instead of such a compression force, each displaceable compression jaw may be fitted with its own drive system, for instance with a hydraulic actuator. Such an actuator may be a pressure or a traction force.

In a modification or deviation from the above, however, at least part of the displaceable compression jaws may be seated on pivot levers pivoted by the drive system(s). Such assemblies of pivot levers already are known from the German Offenlegungsschrift 34 23 283. They may be stationary on the compression tool, at least as regards the actuation of the compression jaws near the rest. There is the possibility, similarly to the compression tool of the German Offenlegungsschrift 34 23 283, of mounting the compression jaws in compression-jaw supports pivotally resting on the pivot levers. To control the displacement of the compression-jaw holders, a slide means may be used, again as already disclosed in the German Auslegeschriften 34 23 283.

The invention furthermore provides that the rest may be part of a compression-ring having hinged compression jaws, which is open between two compression jaws, the compression ring being closed when called for by the drive system (s). For that purpose, the drive system(s) may act on the free ends of the compression ring. This embodiment mode makes it possible to design the compression-ring drive system(s) separately, and for the drive system(s) and the compression ring to include coupling components so that they may be operationally coupled. In that case, the compression tool is in two parts, with the compression ring first being laid around the workpiece while the compression jaw acting as a rest against which the workpiece was abut, and then secondly the compression tool being placed against the compression ring. This embodiment permits very easy handling because the individual components are substantially more lightweight, and can be handled independently from each other.

The compression ring may comprise at least one traction belt resting externally against at least the displaceable compression jaws in order to make the compression jaws move relative to each other, and two traction belts also may be provided for that purpose too. This design is especially lightweight and economical.

To assure that the end-face gaps between the compression jaws are precisely identical at the beginning of compression, a further feature of the invention provides that at least part of the compression jaws in the compression-jaws supports are displaceable relative to these, with corresponding guide systems being present to ensure such equal gaps between the compression jaws at the beginning of compression. Essentially, the compression jaws can be guided displaceably along the periphery. Slide guides are applicable as guide systems, however spring-loading toward stops also may be used.

In yet another feature of the invention, the pressing jaws mounted to the compression ring are fixed thereto so that they essentially move only radially. This feature is particularly useful for workpieces of relatively small diameter. In addition, the press jaws, which can assume essentially any configuration in the compressed position, may be integral with and form a portion of the components of the hingedly interconnected compression ring.

DESCRIPTION OF THE DRAWINGS

The drawings more closely illustrate embodiments of the invention.

DESCRIPTION OF THE INVENTION

Figure 1:
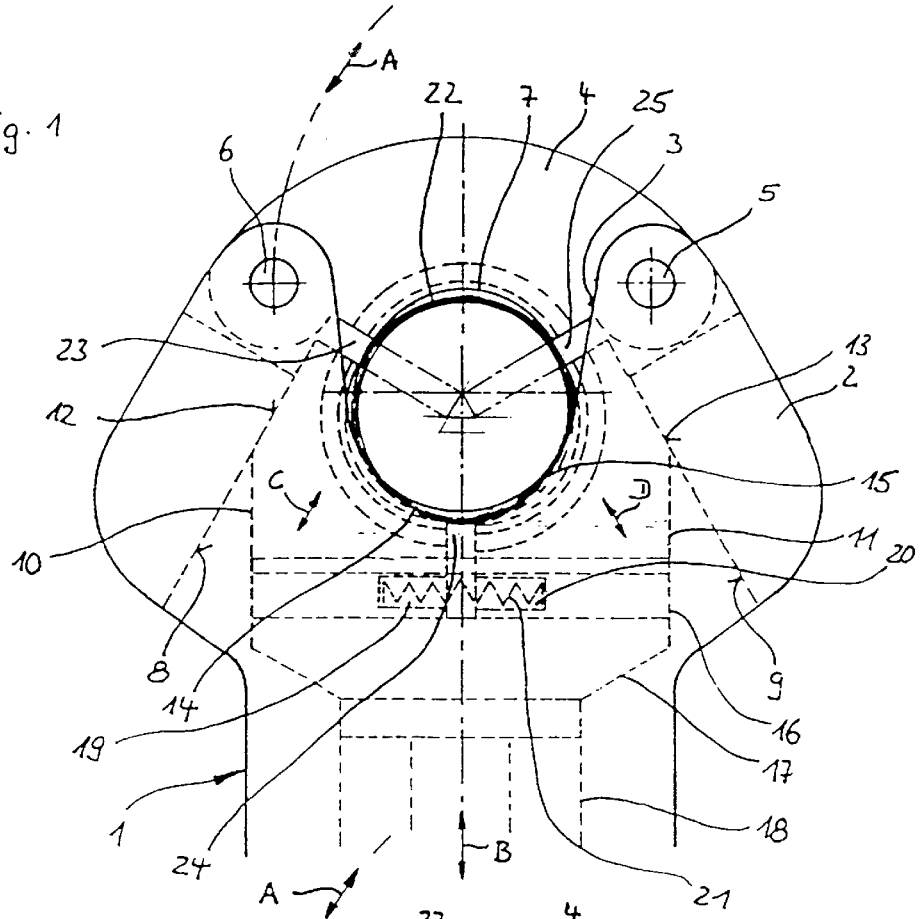
FIG. 1 is a compression tool in the open position.
Figure 2:
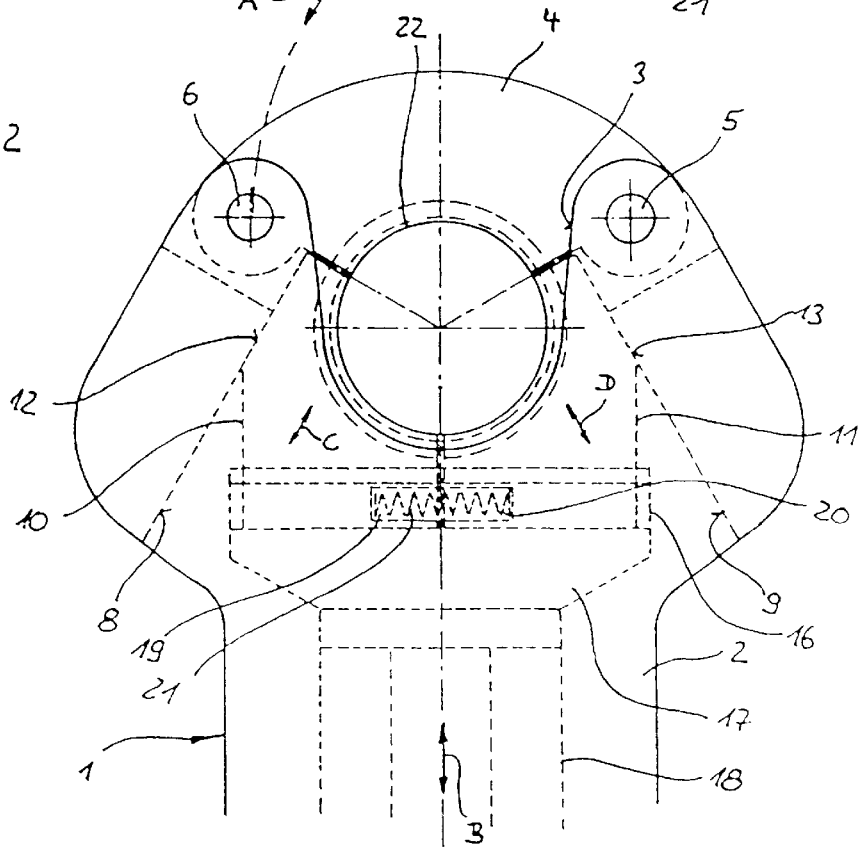
FIG. 2 is the compression tool of FIG. 1 in the closed position.

FIGS. 1 and 2 show only the upper head part of a compression tool 1. It comprises a tool housing 2 hollow on the inside and which first flares upward and then tapers conically. A U-shaped clearance 3 is present at the middle.

The free ends of the clearance 3 are connected by a rest-yoke 4. The rest-yoke 4 is pivotally supported by a support bolt 5 shown on the right in this view. On the left side, the rest-yoke 4 is fixed in the shown position by a locking bolt 6. This locking bolt 6 passes through matching clearances in the tool housing 2 and in the rest 4, and is easily removed. After it has been removed, the rest-yoke 4 can be pivoted about the support bolt 5 in the direction of the double arrow A, namely clockwise until the clearance 3 is totally open in the upward direction.

On its inside the rest-yoke 4 comprises an arcuate compression surface 7 subtending an angle of 120° symmetrical to the longitudinal axis of the compression tool 1. The compression surface 7 comprises a peripheral groove which opens inward. It can be exchangeably mounted to rest-yoke 4.

Oblique guide surfaces 8, 9 extend inside the tool housing 2 and subtend an angle of 60° and are mirror-symmetrical with respect to the longitudinal axis of the compression tool 1. One compression jaw 10, 11 rests against the guide surfaces 8, 9 across correspondingly oblique support surfaces 12, 13. The compression jaws 10, 11 also are mirror-symmetrical with respect to the longitudinal axis of the compression tool 1 and each has a compression surface 14, 15 in the form of arcs of circle of 120°. They too have a peripheral groove on the inside. The arcs of circle of all the compression surfaces 7, 14, 15 evince the same radii. The compression jaws 10, 11 enter at the bottom a guide groove 16 which is horizontal and transverse to the longitudinal axis of the compression tool 1, the groove being formed in the head 17 of a compression force 18. The lower sides of the compression jaws 10, 11 also are horizontal, whereby the compression jaws 10, 11 are displaceably guided in the groove 16 transversely to the longitudinal axis of the compression tool 1, namely in geometrically locking manner as in a dovetail guide.

Transverse and coaxial blind holes 19, 20 are present in the lower segments of the compression jaws 10, 11. A compression spring 21 is set into these blind holes 19, 21 and biases the compression jaws 10, 11 outward and thereby, on account of the support surfaces 12, 13, against the guide surfaces 8, 9. The compression force 18 is supported in vertically and linearly displaceable manner in the direction of the longitudinal axis of the compression tool 1 (double arrow B). It is actuated by a pneumatically or hydraulically loaded actuator not shown herein in further detail.

When the compression tool 1 is being used, first the lock of the rest-yoke 4 is loosened by means of the locking bolt 6, i.e. the locking bolt 6 is pulled out and the rest-yoke 4 is pivoted clockwise until the fork-shaped aperture 3 is entirely cleared. Simultaneously, the compression force of actuator 18 is disposed in the downwardly retracted position. The compression tool 1 thereupon can be set on a coupling sleeve 22, so that the sleeve extends perpendicularly to the plane of the drawing through the clearance 3 in which it is received. Thereupon the rest 4 is pivoted back about the coupling sleeve 22, and locked by inserting the locking bolt 6. Now the coupling sleeve 22 has been enclosed by the compression tool 1.

Thereupon the compression jaws 10, 11 are made to rest against the coupling sleeve 22 by raising the compression force 18. Because their radius is less than the anticipated squeeze depth of the radius of the coupling sleeve 22 prior to the compression, the compression surfaces 7, 14, 15 rest by their outer transverse edges against the periphery of the coupling sleeve 22. Free gaps 23, 24, 25 of equal size are disposed between the end faces of the compression jaws 10, 11 and the rest-yoke 4. The radii of the arcs of circle of the compression surfaces 7, 14, 15 originate at centers located on the apices of an isosceles triangle.

The compression force 18 is raised upon further application of pressure. In the process, the compression jaws 10, 11 slide by means of their support surfaces 12, 13 over the guide surfaces 8, 9, whereby a motion in the directions of the arrows C, D is imparted to them. The two directions of motion subtend the same angle as the guide surfaces 8, 9, namely 60°. In this process the compression jaws 10, 11 slide simultaneously and horizontally inside the groove 16 of the compression force 18 toward one another and against the opposition of the compression spring 21. The coupling sleeve 22 is swaged radially in this manner, that is, its diameter is reduced by the desired squeeze depth. At the end of compression, the compression surfaces 7, 14, 15 enclose a circular compression space and the gaps 23, 24, 25 have become eliminated.

To remove the compression tool 1 from the coupling sleeve 22, then the compression force 18 is moved back again. Following removal of the locking bolt 6, the rest-yoke 4 is pivoted away whereby the compression tool 1 can be removed.

Figure 3:
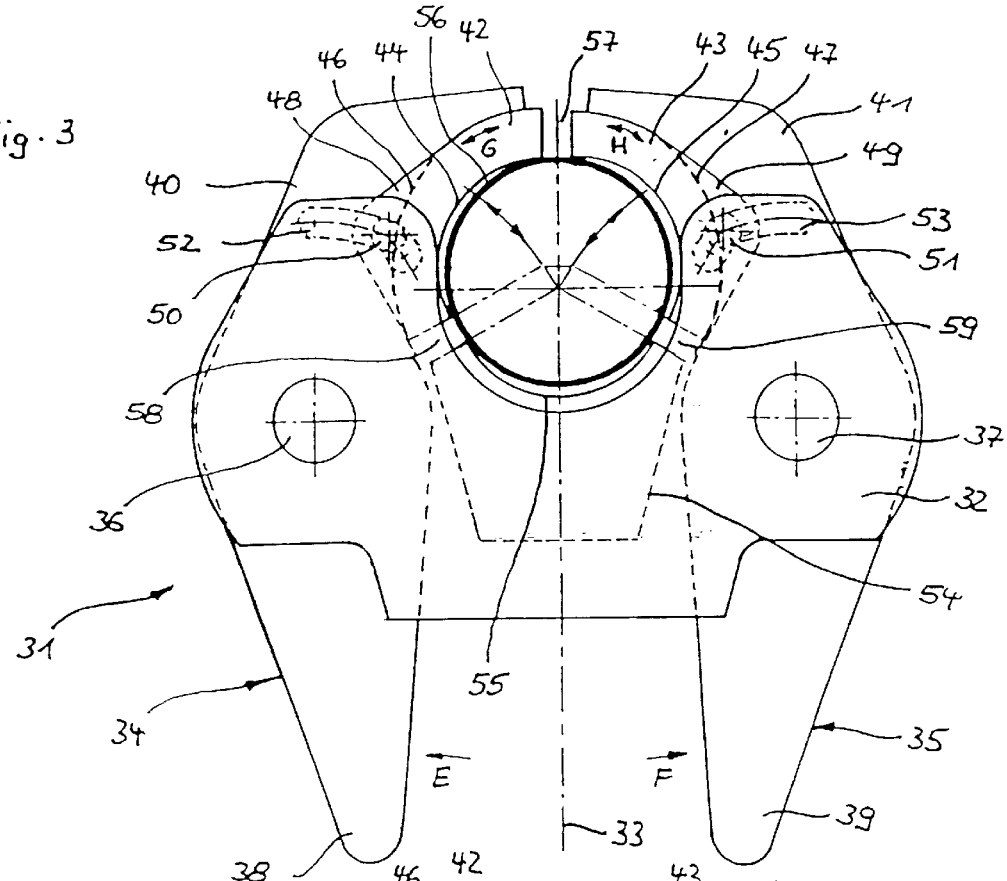
FIG. 3 is another compression tool in the open position.
Figure 4:
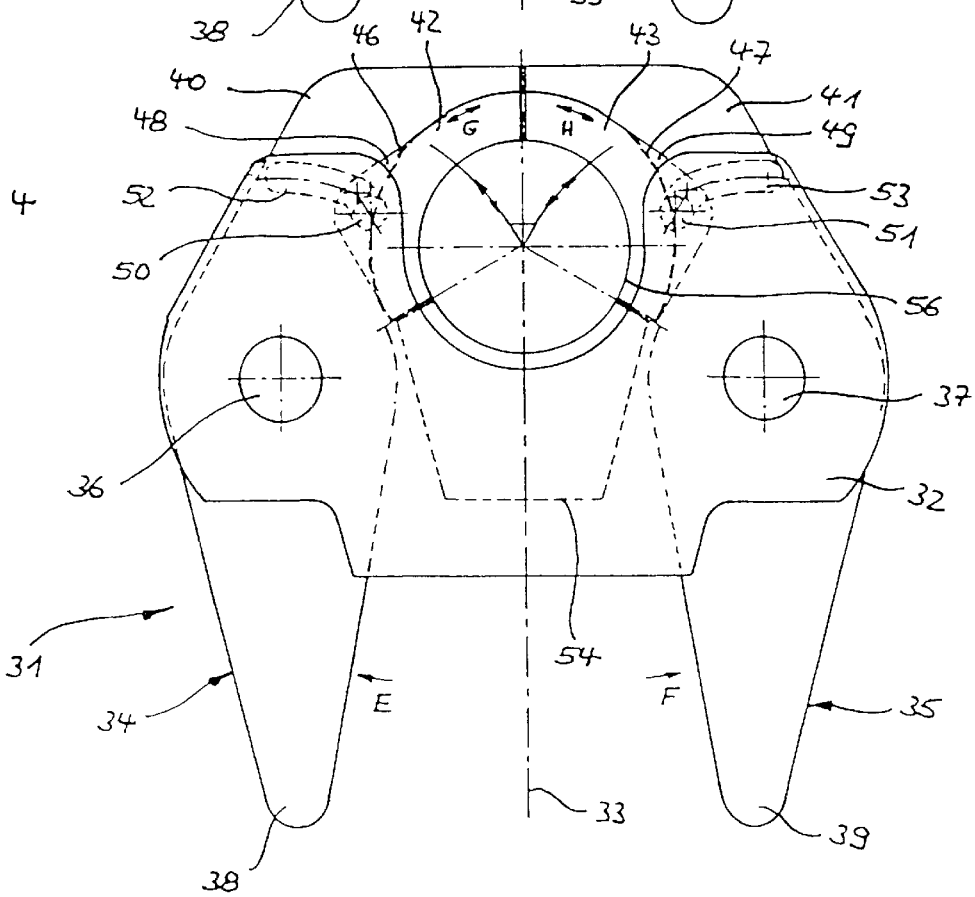
FIG. 4 the compression tool of FIG. 3 in the closed position.

Again FIGS. 3 and 4 shown a compression tool 31 only in part, namely its head region. The compression tool 31 comprises a tool housing 32 which is hollow on the inside and which extends downward to receive a drive and to allow handling, though this is not shown herein in further detail.

Two drive levers 34, 35 in the tool housing 32 extend in mirror-symmetry to the longitudinal axis 33 and are supported pivotally on pivot bolts 36, 37 perpendicular to the plane of the drawing. The downward arms 38, 39 of the drive levers 34, 35 are spread apart in the directions of the arrows E, F in order to pivot against the opposition of a spring, not shown here in further detail, which pulls together the arms 38, 39. A pair of pressure rollers is used to spread apart the arms 38, 39, the pair being moved by a pneumatically or hydraulically driven linear actuator into the gap between the arms 38, 39. Such a drive is known per se from the German Patent 21 36 782 and from the German Offenlegungsschrift 34 23 382.

Compression jaws 42, 43 are seated in the arms 40, 41 of the drive levers 34, 35 that extend upward from the pivot bolts 36, 37. Each compression jaw 42, 43 has inside compression surfaces 44, 45 forming arcs of circle of 120°. Both compression jaws 42, 43 are displaceably supported on the arms 40, 41 of the drive levers 34, 35 so that they move in the circumferential directions shown by the arrows G, H. For such purpose they rest by their outsides against corresponding arcuate guide surfaces 46, 47 of the arms 40, 41 coaxial with the arcs-of-circle segments of the particular compression surfaces 44, 45.

The compression jaws 42, 43 comprise laterally and externally projecting beaks 48, 49 on both sides of the guide surfaces 46, 47. The beaks 48, 49 comprise guide projections 50, 51 entering, in geometrically constrained manner, slides 52, 53 inside the tool housing 32. Thus, the compression jaws 42, 43 are guided in constrained manner in the circumferential direction G, H while the drive levers 34, 35 are being pivoted.

A further compression jaw is formed by a stationary rest 54 inside the tool housing 32 and having a compression surface 55 at the top in the form of an arc of circle of 120°. The radius of the arc of circle is the same as that of the remaining compression surfaces 44, 45.

In order to use the compression tool 31, first the arms 38, 39 of the drive levers 34, 35 are manually pushed together, that is opposite the directions E, F. The arms 40, 41 thereby open like tongs and provide access to the space between the end faces of the compression jaws 42, 43, so that the compression tool 31 can be slipped over a coupling sleeve 56 transversely to the sleeve's longitudinal axis. The compression jaws 42, 43 are closed after the coupling sleeve 56 has been placed against the compression surface 55 of the rest 54. This takes place by spreading apart the lower arms 38, 39 of the drive lever 34, 35 by means of a drive system not shown in further detail herein. Thereupon the compression jaws 42, 43 come to rest against the outside surface of the coupling sleeve 56. Because, before compression, the radii of the compression surfaces 44, 45, 55 are less by the anticipated squeeze depth than the radius of the coupling sleeve 56, the compression surfaces 44, 45, 55 rest on the periphery of the coupling sleeve 56 only by their external transverse edges. In order that equal gaps 57, 58, 59 exist between the end faces of the compression jaws 42, 43 and of the rest 54, the slides 52, 53 are shaped so that the compression jaws 42, 43 are correspondingly circumferentially displaced relative to the arms 40, 41 of the drive levers 34, 35, that is, the left compression jaw 42 moves clockwise and the right compression jaw 43 counterclockwise. The radii of the arcs of circle of the compression surfaces 44, 45, 55 start from origins located on the apices of an isosceles triangle.

The lower arms 38, 39 of the drive levers 34, 35 are spread apart additionally by increasing the pressure-loading on the drive system. As a result, the compression jaws 42, 43 are moved further inward, the two directions of motion substantially subtending an angle of 60° which is symmetrical to the longitudinal axis 33 and which opens away from the rest 54. This is due to the pivot bolts 36, 37 each being on straight lines starting from the origin of the arc of circle of the rest 54 and subtending an angle twice as large as that subtended by the directions of motion of the compression jaws 42, 43, ie 120°. Because the upper gap 57 between the end faces of the compression jaws 42, 43 would be reduced faster during compression than the gap between the compression jaws 42, 43 and the rest 54, the slides 52, 53 curve inward and downward in such manner that the compression jaws 42, 43 are circumferentially displaced relative to the arms 40, 41, namely the left compression jaw 42 counterclockwise and the right compression jaw 43 clockwise. The guidance of the slides 52, 53 is such that the gaps 57, 58, 59 remain constant during the entire compression until the end faces of the compression jaws 42, 43 and of the rest 54 make contact at the end of compression. The coupling sleeve 56 is radially swaged in this process and its diameter is reduced by the desired squeeze depth.

In order to remove the compression tool 31 from the coupling sleeve 56, then the lower arms 38, 39 of the drive lever 34, 35 are pushed together so that the upper arms 40, 41 open like tongs. The compression tool 31 thereupon can be removed from the coupling sleeve 56.

Figure 5:
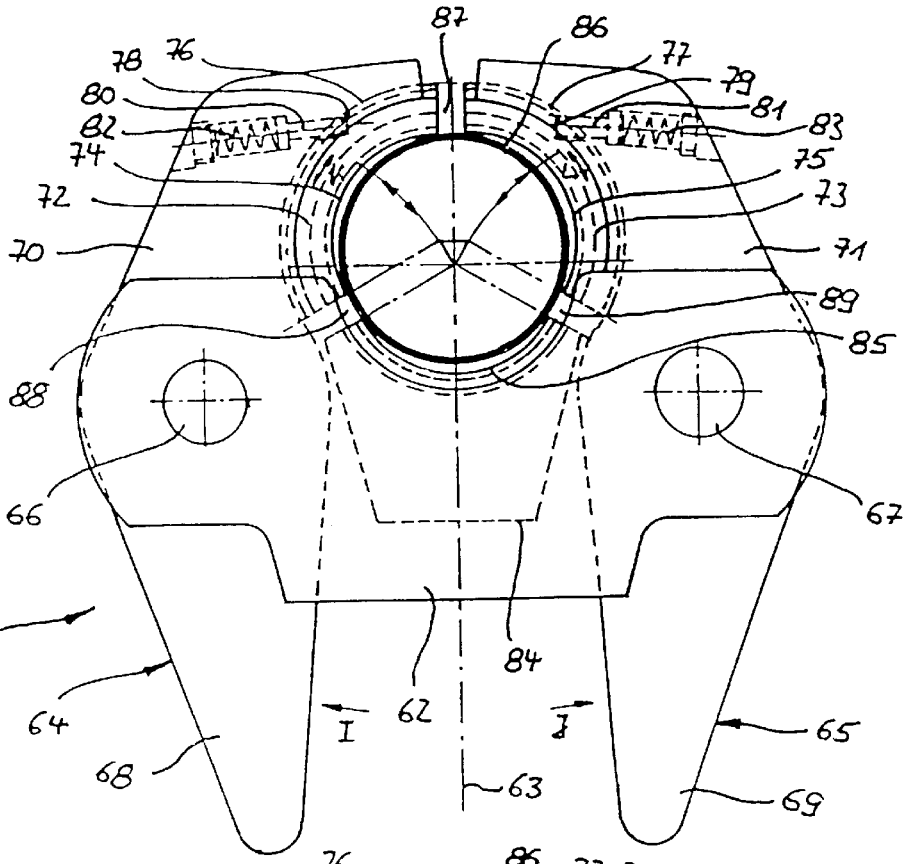
FIG. 5 further compression tool in the open position.
Figure 6:
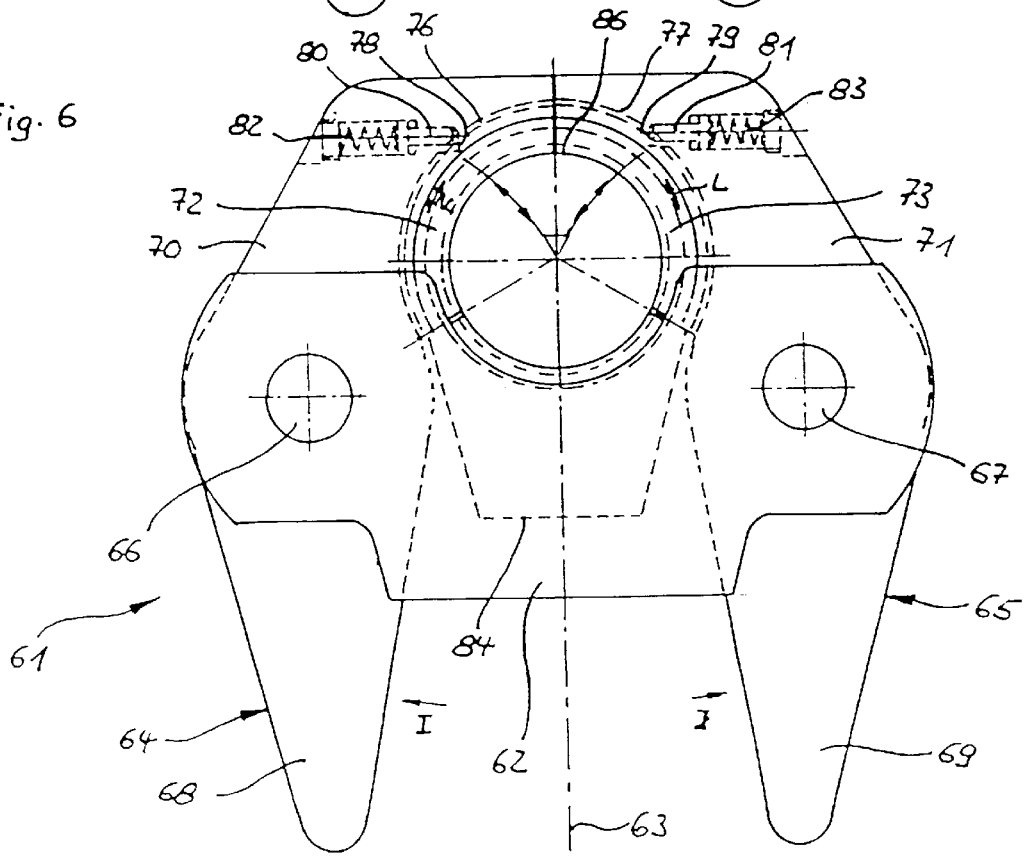
FIG. 6 is the compression tool of FIG. 5 in the closed position.

FIGS. 5 and 6 show a compression tool 61, again only in part, which is quite similar to the compression tool 31 of FIGS. 3 and 4. It comprises an internally hollow tool housing 62 extending downwardly to receive a drive system and to allow handling, and is not shown herein in further detail.

Two drive levers 64, 65 are rotatably supported in the tool housing 62 and in mirror-image manner relative to the longitudinal axis 63 on pivot bolts 66, 67 perpendicular to the plane of the drawing. The downward arms 68, 69 of the drive levers 64, 65 are spread apart in the directions of the arrows I, J for purposes of pivoting and against the opposition of a spring, not shown in further detail, pulling together the lower arms 68, 69. A pair of pressure rollers is used to spread apart the arms 68, 69 in the manner already described in relation to the compression tool 31 of FIGS. 3 and 4.

Compression jaws 72, 73 are seated in the arms 70, 71 of the drive levers 64, 65, where the arms extend upward from the pivot bolts 66, 67. These compression jaws each comprise inside compression surfaces 74, 75, each forming arcs of circle of 120°. Both compression jaws 72, 73 are supported on the upper arms 70, 71 of the drive levers 64, 65 so as to be circumferentially displaceable in the directions of the arrows K, L. For that purpose they rest by their outsides against corresponding arcuate guide surfaces 76, 77 in the arms 70, 71 which are coaxial with the arcs of circle of the particular compression surfaces 74, 75.

The compression jaws 72, 73 have notches 78, 79 at their external peripheries which are engaged by pins 80, 81 axially displaceably seated in the upper arms 70, 71. These pins 80, 81 are biased by compression springs 82, 83 toward the notches 78, 79.

The pins 80, 81 and the notches 78, 79 are arranged in such a way that the pins 80, 81 tend to move the compression jaws 72, 73 circumferentially toward each other, namely the left compression jaw 74 clockwise and the right compression jaw 73 counter-clockwise. Stops, not shown in further detail herein, assure that the compression jaws 72, 73 cannot be displaced beyond a maximum distance in these two directions. Obviously the guidance of the compression jaws 72, 73 is such that they cannot drop out of their seats in the arms 70, 71, and inward, ie, constrained guidance is provided.

A further compression jaw is formed by a rest 84 mounted in stationary manner inside the tool housing 62 and having at its top a squeezing surface 85 in the form of a 120° arc of circle. The arc of circle has the same radius as that of the other compression surfaces 74, 75.

When the compression tool 61 is put to use, first the lower arms 68, 69 of the drive levers 64, 65 are manually forced together, that is opposite the directions of the arrows I, J. As a result, the upper arms 70, 71 open like tongs and provide a space between the end faces of the compression jaws 72, 73 whereby the compression tool 61 can be slipped over a coupling sleeve 86 transversely to the latter's longitudinal axis. When the coupling sleeve 86 makes contact with the compression surface 85 of the rest 84, the compression jaws 72, 73 can be closed by a spreading apart the lower arms 68, 69 using a drive system not shown herein in further detail. The compression jaws 72, 73 then come to rest against the outer surface of the coupling sleeve 86. Because the radii of the compression surfaces 74, 75, 85 are less by the anticipated squeeze depth than the radius of the coupling sleeve 86 prior to compression, the compression surfaces 74, 75, 85 rest against the periphery of the coupling sleeve 86 by their outer transverse edges.

In order that equal-size gaps 87, 88, 89 exist between the end faces of the compression jaws 72, 73 and of the rest 84, then stops limiting the circumferential motion of the compression jaws 72, 73 are mounted accordingly. The radii of the arcs of circle of the compression surfaces 74, 75, 85 start from centers located on the apices of an isosceles triangle.

By further loading the drive system, the lower arms 68, 69 of the drive levers 64, 65 are spread apart even more. As a result, the compression jaws 72, 73 are moved further inward, the two directions of motion essentially subtending an angle of 60° symmetrical in relation to the longitudinal axis 63 and opening away from the rest 84. Again the reason is that the pivot bolts 66, 67 each are located on straight lines starting from the center of the arc of circle of the rest 84 and subtending an angle of 120°.

During compression, the compression jaws 72, 73 automatically shift circumferentially relative to the upper arms 70, 71, namely the left compression jaw 72 counter-clockwise and the right compression jaw 73 clockwise. It was found that the gaps 87, 88, 89 in this embodiment remained essentially equal, in spite of the inaccurate guidance during the entire compression procedure, until the end faces of the compression jaws 72, 73 and of the rest 84 come to touch at the end of compression, as shown in FIG. 6. In the process, the coupling sleeve 86 is radially swaged and its diameter is reduced by the desired squeeze depth.

Figure 8:
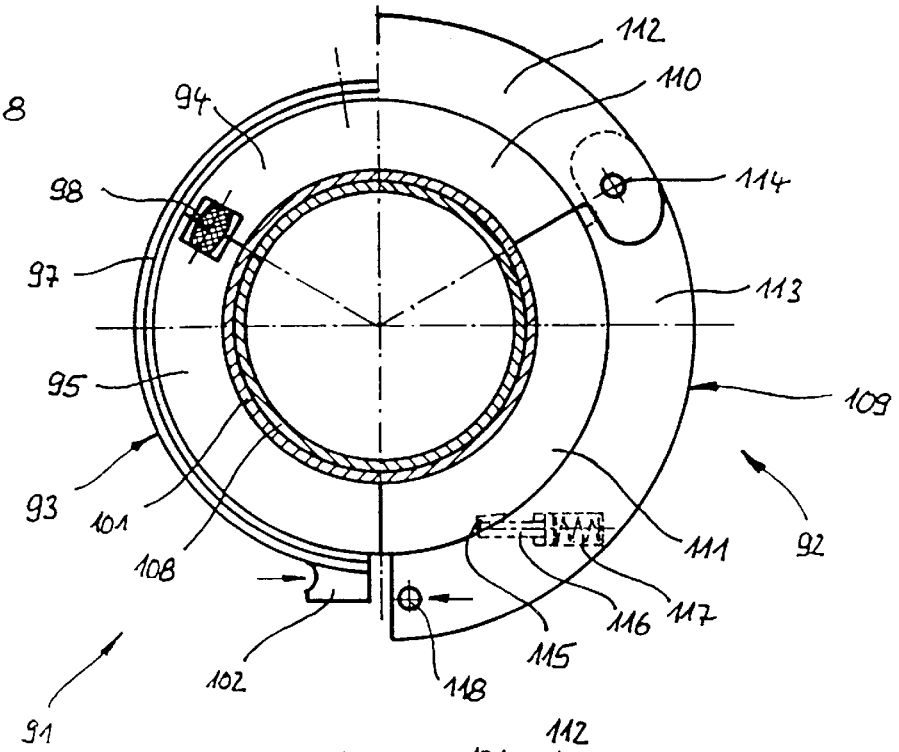
FIG. 8 shows the compression tools of FIG. 7 in the closed position.
Figure 7:
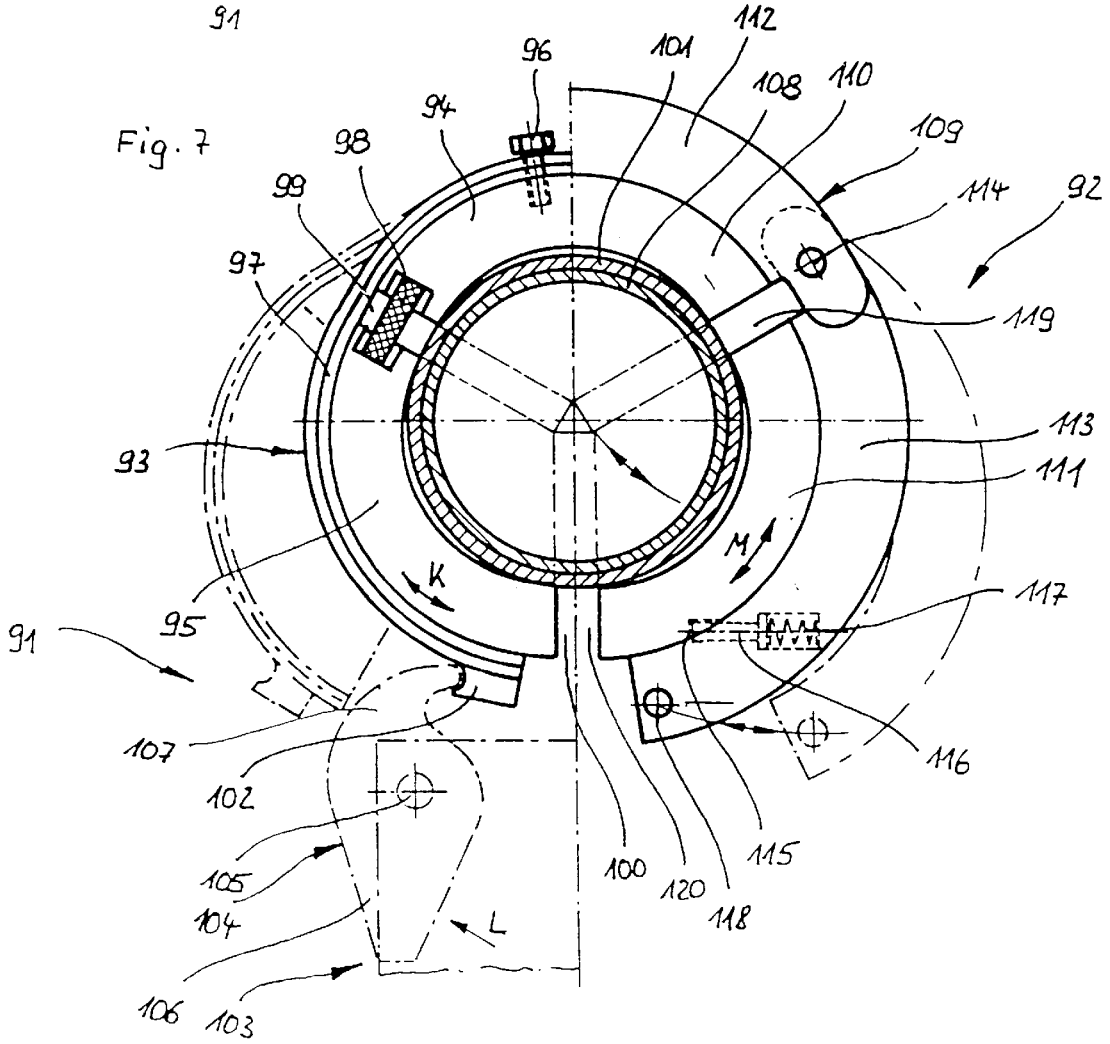
FIG. 7 is a half-representation of two further compression tools in the open position.

FIGS. 7 and 8 show two compression tools 91, 92 each by its half. The left half of FIGS. 7 and 8 as regards the axis of symmetry shows the compression tool 91 and the right half the compression tool 92. Both compression tools 91, 92 are mirror-symmetrical and their design already is known from their half-representations.

The compression tool 91 shown on the left in FIGS. 7 and 8 comprises a compression ring 93 consisting of a total of three compression jaws 94, 95; on account of the half-representation the compression jaw 94 appears only in part—and one compression jaw, namely the one on the right hand side, not at all. A flexible traction belt 97 made of spring steel is affixed by means of a screw 96 to the upper compression jaw 94 and extends over the periphery of the upper compression jaw 94 and the left compression jaw 95. A corresponding traction belt is present on the other side (omitted) of the compression ring 93.

The lower compression jaws 95 are guided on the traction belt 97 so as to be circumferentially displaceable in the direction K. One rubber spring 98 enters each clearance in the opposite end faces of the compression jaws 94, 95 and is vulcanized onto them. In the unloaded state, the compression jaws 94, 95 are forced apart to a given extent by the rubber springs 98 and as a result equally wide gaps 99, 100 are created between the opposite end faces of the compression jaws 94, 95 when these rest externally against a coupling sleeve 101.

External connection fittings 102 are mounted on the free ends of the traction belts 97. A drive system 103 separate from the compression ring 93, and indicated here merely schematically and in dash-dot lines, can be linked to these connection fittings 102. Accordingly the compression tool 91 consists of two independent parts that can be hooked up together.

The drive system 103 comprises two drive levers 104, of which only the left one is shown. They are rotatably supported on pivot bolts 105 which are perpendicular to the plane of the drawing. The downward arms 106 are spread in the direction of the arrow L for purposes of pivoting, and this against the opposition of a tension spring, not shown in further detail, which pulls on the lower arms 106. In order to spread apart the arms 106, a pair of pressure rollers is used as described already in relation to the compression tool 31 and FIGS. 3 and 4. The arms 107 rising from the pivot bolts 105 are shaped in such a way that they can engage the connection fittings 102 from behind.

When using the compression tool 91, first the compression ring 93 is opened, whereby the lower compression jaws 95 are externally out of the way in the manner indicated by dash-dot lines. Thereupon the compression ring 93 can be slipped over the combination of coupling sleeve 101 and pipe end 108 transverse to the longitudinal axis. Because of the spring action of the traction belts 97, the compression jaws 94, 95 come to rest against the periphery of the coupling sleeve 101, and again only by their external transverse edges. Thereupon the drive system 103 is made to contract in such manner that the upper arms 107 of the drive levers 104 externally engage the connection fittings 102 from behind in the manner shown by FIG. 7. The drive levers 104 then are spread apart in the manner previously described, whereby the traction belts 97 are pressed together at their free ends. As a result, the coupling sleeve 101 and the pipe end 108 are radially swaged, the lower compression jaws 95 automatically moving circumferentially, namely the left lower compression jaw 95 clockwise and the right lower compression jaw counter-clockwise. This takes place until the end faces of the compression jaws 94, 95 come to rest against each other, the rubber springs 98 being compressed. This state is shown in FIG. 8.

The compression tool 92 is designed similarly as regards operation as the tool 91.

It also comprises a compression ring 109 with three compression jaws 110, 111 of equal lengths. The upper compression jaw 110 is rigidly joined to a compression-jaw support 112, and the two lower compression jaws 111 are circumferentially and displaceably guided on compression-jaw supports 113. The compression-jaw supports 113 are linked by pivot links 114 to the upper compression jaw support 112.

The lower compression jaws 111 comprises notches 115 at their outer peripheries, the notches being entered by axially displaceable pins 116 resting in the lower compression jaw supports 113. These pins 116 are spring-loaded by compression springs 117 toward the notches 115. The pins 116 and the notches 115 are arranged in such manner that the pins are biased to move the lower compression jaws 111 toward each other, namely the shown right lower compression jaw 111 clockwise and the omitted compression jaw counter-clockwise. Stops, not shown in further detail, assure that the lower compression jaws 111 cannot go beyond maximum distances in these two directions.

Drive bolts 118 projecting vertically from the plane of the drawing and assume the function of the connection fittings 102 of the compression tool 91 and are mounted to the free ends of the lower compression jaws supports 113. The drive system 103 shown in the left half of FIGS. 7 and 8 can be hooked-up to these drive bolts 118 by placing the upper arms 107 of the drive levers 104 against the outsides of the drive bolts 118.

The handling of the compression tool 92 is the same as for the compression tool 91. Initially the compression ring 109 is slipped over the coupling sleeve 101 and the pipe end 108 transversely to their longitudinal axis, the two lower compression jaw supports 113 being open, ie being pivoted outward as indicated by the dash-dot lines.

Then the lower compression jaw supports 113 are made to rest against the outer periphery of the coupling sleeve 101. The previously mentioned circumferential motion stops for the lower compression jaws 111 are mounted in such a way that upon contact with the coupling sleeve 101, equal-size gaps 119, 120 arise between the end faces of the compression jaws 110, 111.

By further spreading apart the lower arms 106 of the drive levers 104, the lower compression jaws 113 are pivoted inward, the lower compression jaws 111 automatically moving in the circumferential direction M, namely the shown right compression jaw 111 counter-clockwise and the left, omitted compression jaw clockwise. This goes on until the end faces of the compression jaws 110, 111 come into contact at the end of compression. This state is shown in the right half of FIG. 8.

The compression tool 92 does not differ kinematically and hence not in principle from that of FIGS. 5 and 6 nor from the compression tool 31 of FIGS. 3 and 4 because in those compression tools 61, 31 also the compressing motion of the compression jaws 72, 73 and 42, 43 resp. may be implemented by contracting the upper arms 70, 71 and 40, 41 of the drive levers 64, 65 and 34, 35 operating as compression jaw supports in the region of the upper gap 87 and 57 by making use of a correspondingly designed and separate drive system. In that case the lower arms 68, 69 and 38, 39 of the drive levers 64, 65 and 34, 35 are not needed.

Obviously the compression tools 91, 92 also may be made integral, that is the drive system 103 may be connected by an appropriate housing component with one of the compression jaws 94, 95, 110, 111. In that case this compression jaw 94, 95, 110, 111 would be comparable to the rests 4, 54, 84 in the embodiments of FIGS. 1 through 6.

Also, one of the lower compression jaws 95, 111 which is fixed to the compression tool 91, 92 may assume the function of the compression jaw 95, 111 acting as a rest. In this case only one drive lever 104 is required to pull together the compression jaws 94, 95, 110, 111.

Figure 9:
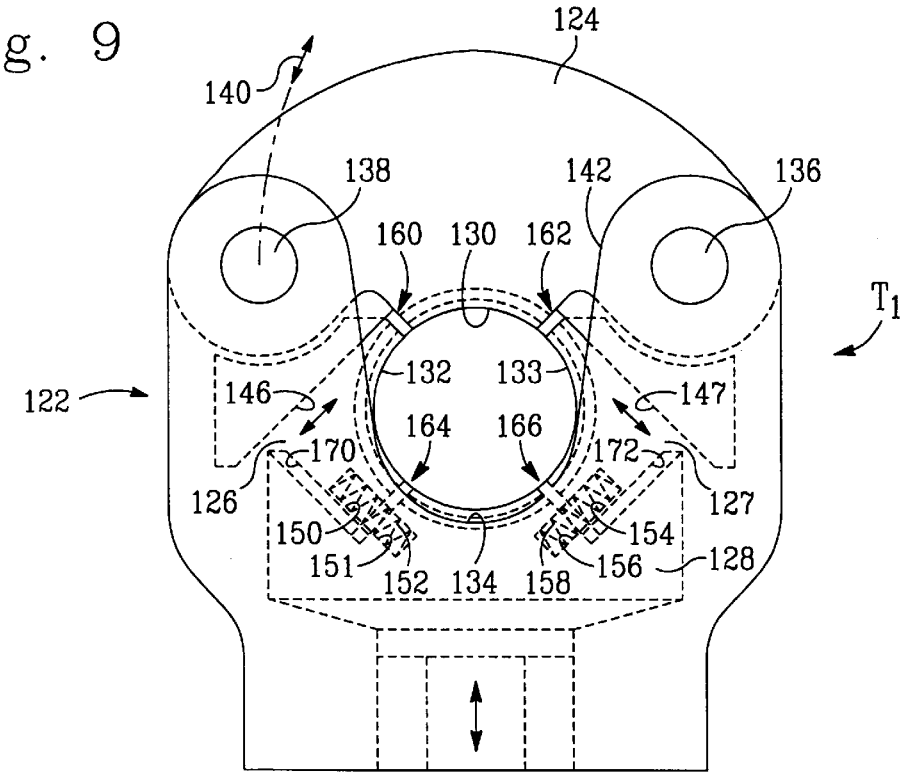
FIG. 9 discloses a further embodiment based upon the tool of FIG. 1, with the tool in the open position.
Figure 10:
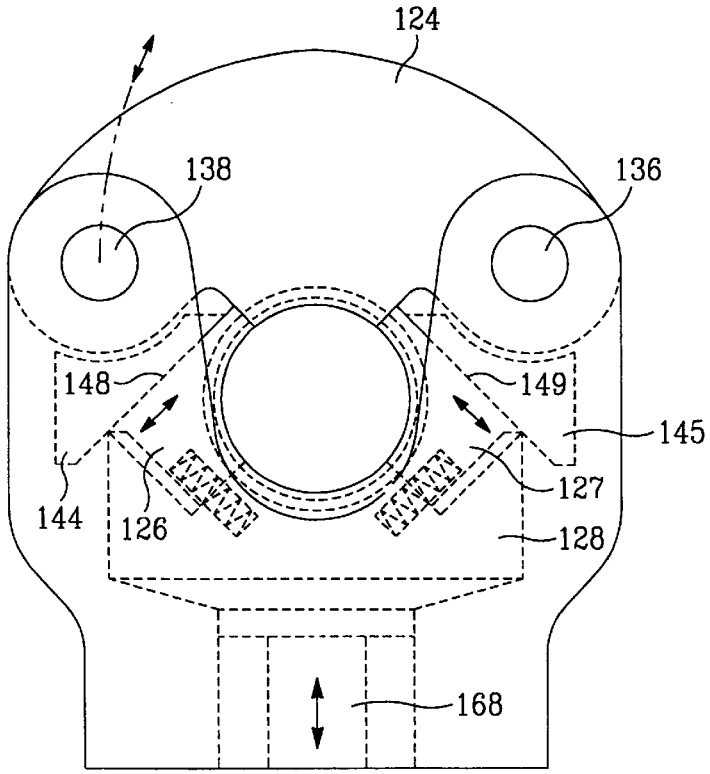
FIG. 10 dicloses the embodiment of FIG. 9 in the closed position.

The tool T 1 of FIGS. 9 and 10 includes a tool housing 122 to which rest yoke 124 is attached. Housing 122 includes supports 126, 127, and 128. Yoke 124 has a compression surface 130 which is arcuate and forms a circle with the cooperating arcuate compression surfaces 132, 133, and 134 of supports 126, 127, and 128, respectively, when the tool T 1 is in the closed or compressed orientation.

Yoke 124 is connected by pivot pin 136 to housing 122. The opposite end of yoke 124 is secured by removable pin 128. Removal of pin 138 permits the yoke 124 to be pivoted about pin 136 in the directions of arrow 140. Removal of pin 138 and pivoting of yoke 124 thereby permits access to the U-shaped clearance 142 formed in the housing 122.

Housing 122 has internal supports 144 and 145, each with a guide surface 146 and 147, respectively. Each of supports 126 and 127 likewise has a guide surface 148 and 149, respectively, so that supports 126 and 127 may slide relative to the supports 144 and 145 when the tool T 1 is shifted between the open position of FIG. 9 and the closed position of FIG. 10.

Support 126 has a bore 150 and support 128 has a bore 151 axially aligned with bore 150. Compression spring 152 is received within bores 150 and 151 in order to bias the support 126 toward the closed position. Similarly, support 127 has a bore 154 axially aligned with bore 156 of support 128. Bores 154 and 156 have compression spring 158 received therein for biasing support 127 to the closed position. The bores 150 and 151 are, preferably, disposed transverse to the bores 164 and 156.

Gap 160 separates support 124 from support 1126, while a similar gap 162 separates support 124 from support 127. Likewise, gap 164 separates support 126 from support 128, while gap 166 separates support 128 from support 127. The gaps 160, 162, 164 and 166 are of uniform dimension as best shown in FIG. 9, so that the supports 124, 126, 127, and 128 are uniformly circumferentially spaced as the tool T 1 is shifted by driver 168 between the open and closed positions.

It can be noted in FIG. 10 that the gaps 160, 162, 164, and 166 have been eliminated as a result of movement of drive 168 and corresponding movement of supports 126, 127, and 128 relative to yoke 124. In the closed position of FIG. 10, compression surface 134 of support 128 has moved into clearance 142.

The supports 126 and 127 each have a side surface 170 and 172, respectively, to which a cooperating surface 174 and 176 of the support 128 is keyed. In this way, upward movement of drive 168, as viewed in FIGS. 9 and 10, causes corresponding movement of support 128 and thereby movement of supports 126 and 127 along guide surfaces 146 and 147.

Figure 11:
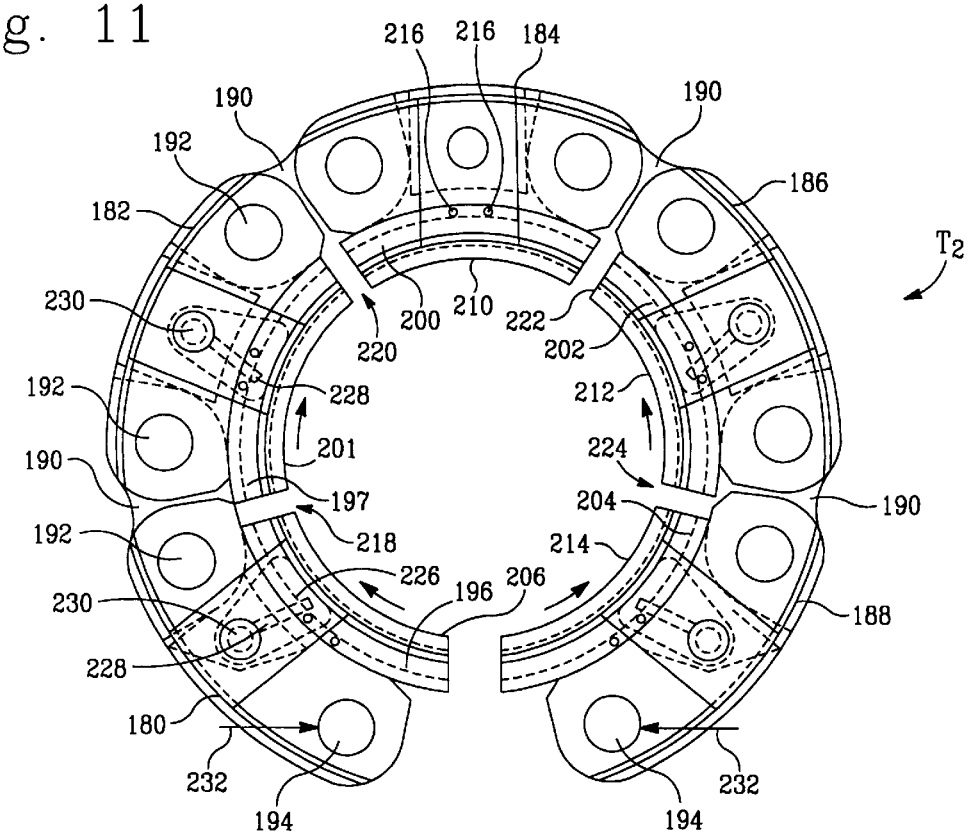
FIG. 11 discloses a further embodiment of the tool of FIGS. 7 and 8, with the tool in the open position.
Figure 12:
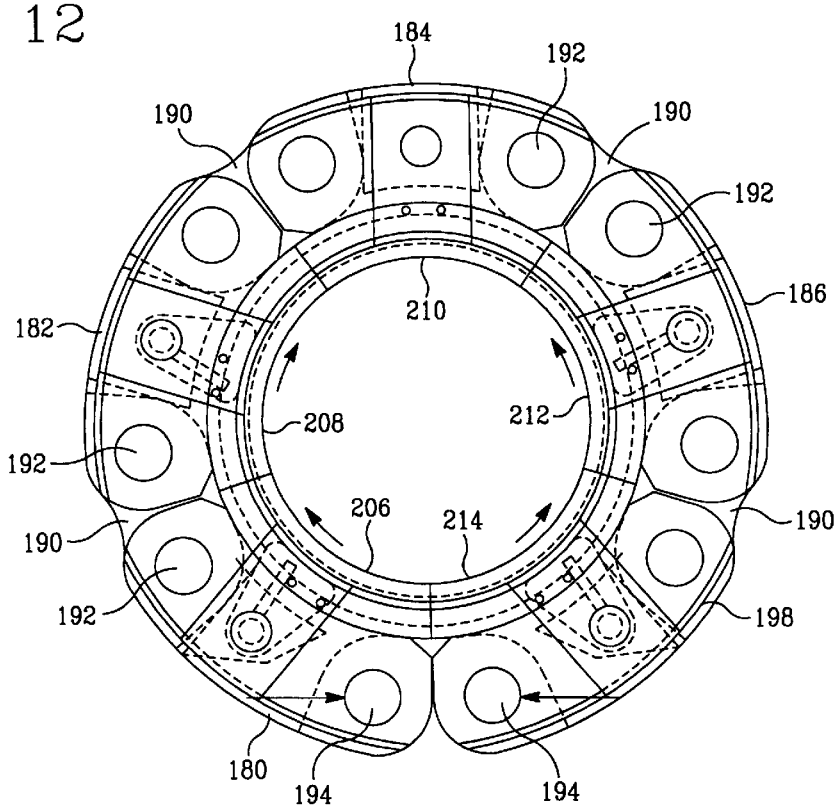
FIG. 12 discloses the tool of FIG. 11 in the closed position.

The tool T 2 of FIGS. 11 and 12 has supports 180, 182, 184, 186, and 188. Links 190 pivotally interconnect each of the supports 180 and 182, 182 and 184, 184 and 186, and 186 and 188 through pins 192. Drive bolts 194 are secured to supports 180 and 188 and extend outwardly and transversely thereto in order to be engaged by a driver (not shown) for causing the bolts 194 to approach and withdraw for thereby shifting the tool T 2 between the open position of FIG. 11 and the closed position of FIG. 12.

Each of the supports carries a cooperating jaw 196, 198, 200, 202, and 204, respectively, and each jaw has an associated compression surface 206, 208, 210, 212, and 214, respectively. The compression surfaces form a circle when the tool T 2 is in the closed position in order to uniformly squeeze the object.

Jaw 200 is fixed to support 184 by pins 216, while each of the other jaws 196, 198, 202, and 204 is movable along its associated support 180, 182, 186, and 188, respectively. Gap 218 separates jaws 196 and 198, while gap 220 separates jaws 198 and 200. Similarly, gap 222 separates jaws 200 and 208, and gap 224 separates jaws 202 and 204. The gaps are uniformly spaced, as best shown in FIG. 11, with the result that the jaws remain uniformly spaced as the tool T 2 is shifted between the open and closed positions.

Each of supports 180, 182, 186, and 188 has a clearance area 226 of generally frustoconical configuration. Each clearance area 226 has a link 228 pivotal therein with respect to pivot pin 230. The links 228 of supports 182 and 186 are disposed between the pins 216 of their associated jaws 198 and 202, while the links 228 of the supports 180 and 188 are in contact with one of the pins 216 of the associated jaws 196 and 204.

Movement of the drive bolts 194 toward each other, as indicated by the arrows 232, causes the tool T 2 to shift from the open position of FIG. 11 to the closed position of FIG. 12. As a result of movement of the drive bolts 194 toward each other, then each of the movable jaws 196, 198, 202, and 204 moves relative to its likewise pivoting support 180, 182, 186, and 188, respectively, as a result of which each of the links 228 is moved within its associated clearance 226 relative to its pin 230. Movement of the drive bolts 194 thereby causes the gaps 218, 220, 222, and 224 to uniformly close until edge surfaces of adjacent jaws contact each other at the closed position. Movement of the drive bolts 194 away from each other, opposite to the direction of arrows 232, causes the gaps to open until the configuration of FIG. 11 is reached.

The pressing device 300 is shown in FIGS. 13 through 16 and is comprised of a press ring 302, which constitutes the compression molding die, and a respective closing device 304.

Figure 13:
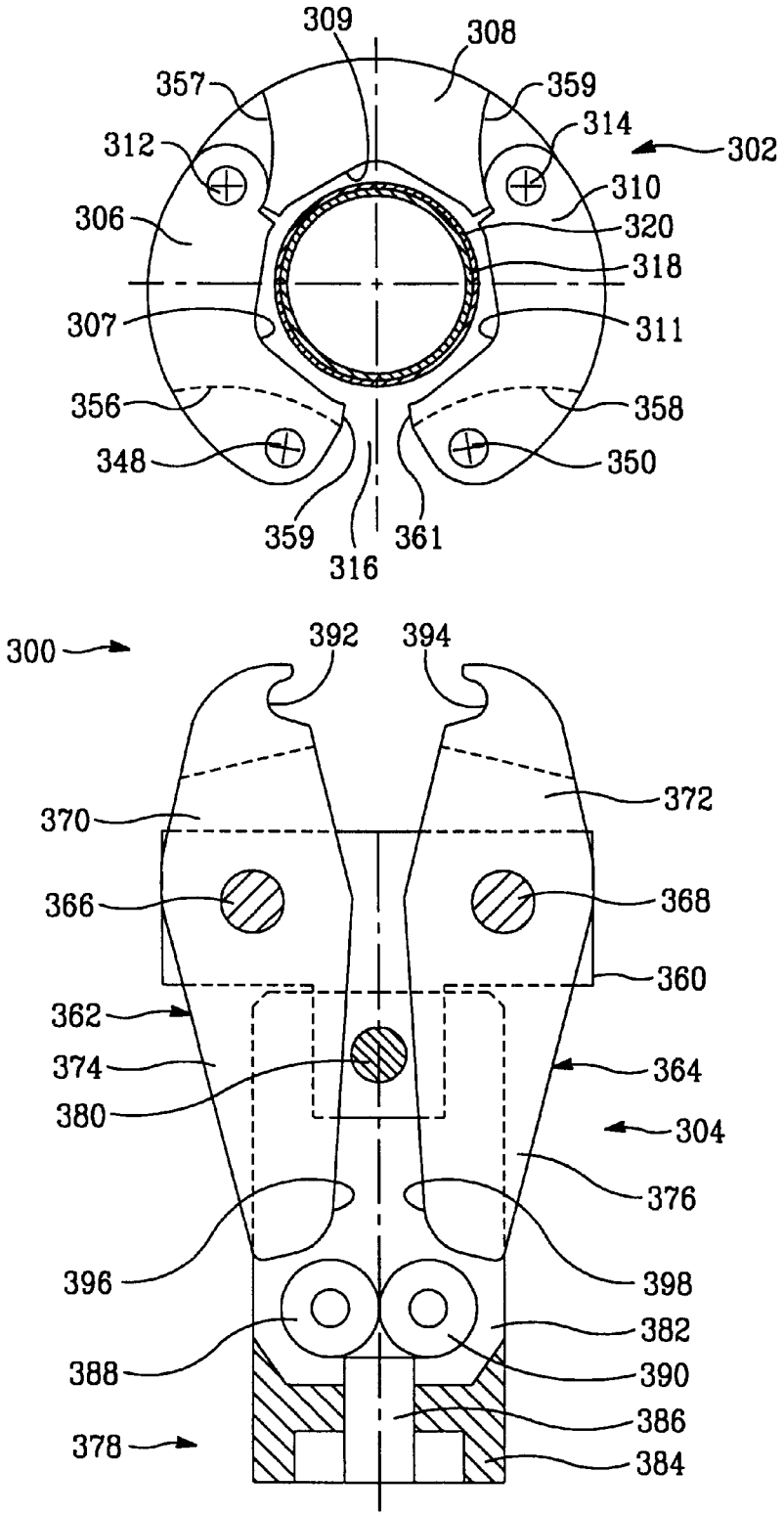
FIG. 13 shows a side view of a pressing device with a compression molding die and a separate closing device in an initial position prior to compression.

The press ring 302 is comprised of three compression jaws 306, 308, and 310, although a greater number may be provided as needed. The compression jaws on the left and right 306, 310 are coupled in a pivot-like manner to the upper compression jaw 308 by means of hinge pins 312, 314. The upper compression jaw 308 contains two recesses 357, 359 to allow for pivoting of the right and left compression jaws 306, 310. The compression jaws 306, 308, and 310 when in the initial or non-press position ensure that there is a closing gap 316 between the adjacent end faces of the left and right side compression jaws 306, 310, as best shown in FIG. 13.

Each of the jaws has a press surface 307, 309, and 311, respectively. The press surfaces preferably are integral with and form a part of the associated compression jaw, thus increasing strength and reducing complexity and manufacturing costs. The press surfaces 307, 309, and 311 may have essentially any configuration, provided that they define a wholly closed space when the compression jaws 306, 308, and 310 are in the closed position of FIG. 14.

The press ring 302 encloses a pipe connection provided by an end area of pipe 318 and a press fitting 320 pushed on top of it. The connection between pipe 318 and press fitting 320 can best be seen in FIG. 16, in which press fitting 320 can be seen in fragmentary form. It has a cylinder section 322, with a reduced diameter portion providing a constriction 324 which acts as a limit stop for the end of the pipe 318. At the free end, the press fitting 320 has an annular ring 326 which bulges radially outwardly and into which an elastomer sealing ring 328 is inserted on the inside. The other end of the press fitting 320, which is not shown, is identical. The compression jaws 306, 310 are located on the outside of the press fitting 320 in the area of the annular ring 326.

Figure 15:
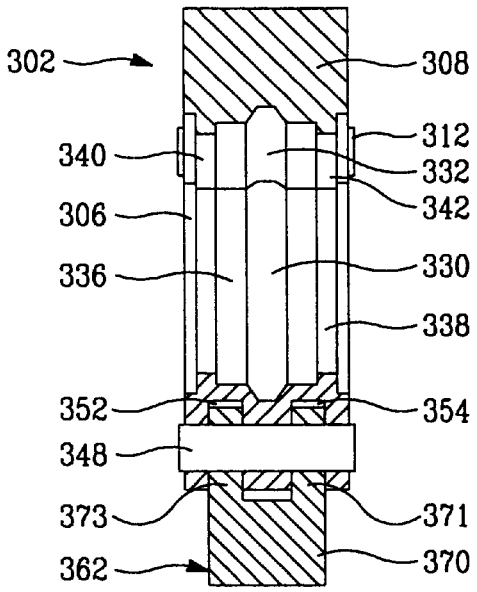
FIG. 15 shows a cross section through the pressing device according to FIG. 14 in the plane A—A.
Figure 16:
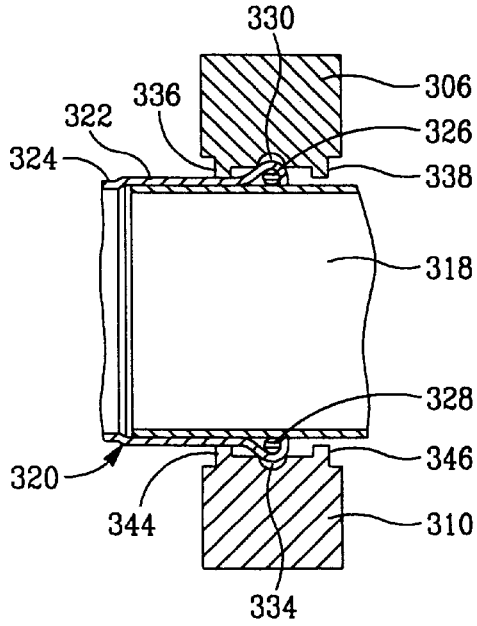
FIG. 16 shows a cross section through the pressing device according to FIG. 14 in the plane B—B.

As can be seen in FIGS. 15 and 16, the compression jaws 306, 308, and 310 provide a compression die with centered, ring-shaped compression grooves 330, 332, 334 and shaping webs 336, 338, 340, 342, 344, and 346 which are at a preselected distance from each other. The compression grooves 330, 332, and 334 engage the annular ring 326 of the press fitting 320 in the position shown in FIG. 16, while the left channel webs 336, 340, and 344 each are applied to the outer circumference of the cylinder of the cylinder section 322.

Coupling pins or drive bolts 348, 350 extend from end portions of the compression jaws 306, 310. The jaws 306 and 308 face each other, and provide a closing gap 316 therebetween when in the open configuration of FIG. 13. As can best be seen in FIG. 15, two channels are formed in the area of the coupling pins 348, 350, whose extensions are marked by means of dash-dot curved lines 356, 358 in FIG. 13.

The closing device 304 is connectable to the press ring 302. It has a T-shaped lever bearing plate 360 to which two adjacent closing levers 362, 364 are linked by means of pivot pins 366, 368. The closing levers 362, 364 are two-armed, symmetrical, and have closing arms 370, 372 which extend upwardly and drive arms 374, 376 which extend downwardly.

In the section of the lever bearing plate 360 which points downwardly, a drive device 378 is provided which is attached by means of a connecting pin 380. The drive device 378 has a plate 382 which encloses the connecting pin 380 and which extends into an hydraulic cylinder 384, which is only partially shown and which has the customary structure. A piston rod 386 can move axially inside the hydraulic cylinder 384, that is, it can be moved vertically, as viewed in the figure. The piston rod 386 is connected in the hydraulic cylinder 384 to a piston which is not shown and to which hydraulic pressure may be applied so that the piston rod 386 is moved. At the upper end of the piston rod 386 there are two opposing, adjacent spread rollers 388, 390 which roll freely.

Figure 14:
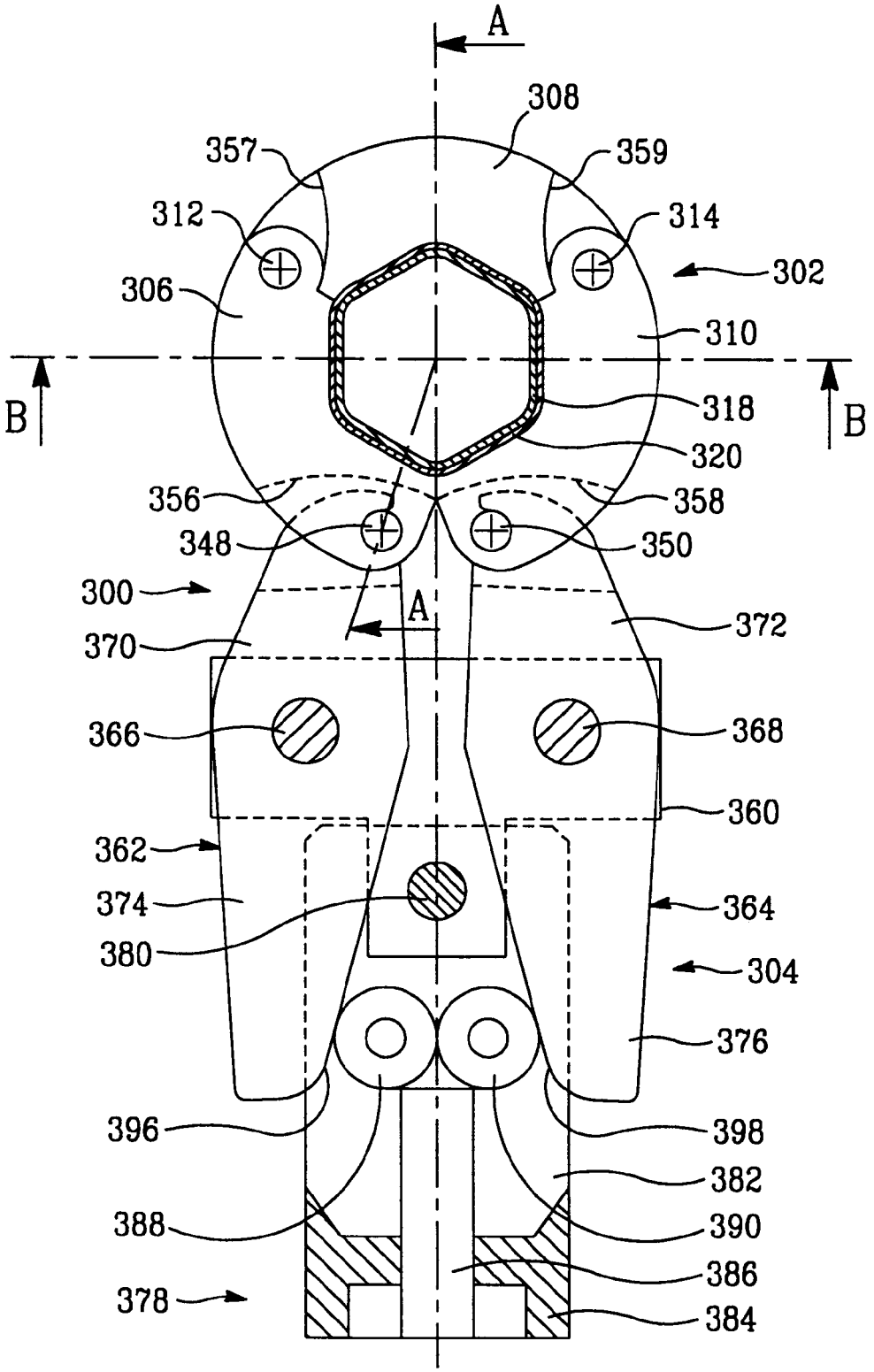
FIG. 14 shows a side view of the pressing device according to FIG. 13 in the final pressing position.

Each of closing arms 370, 372 is forked in the upper end portion, as can be seen in FIG. 15 from tines 371 and 373. The forking is such that the closing arms 370, 372 can be pushed into the channels 352, 354, with the tines positioned within and dimensioned to correspond to the channels as can be seen in FIG. 15. The closing arms 370, 372 have opposing coupling recesses 392, 394, as best shown in FIG. 13, which are securable to the coupling pins 348, 350, as best shown in FIG. 14.

Press ring 302 and closing device 304 are in FIG. 13 separated. The press ring 302 sits loosely on the press fitting 320. In order to carry out the pressing process, the closing device 304 is connected to the press ring 302, so that the tines 371 and 373 of the forked end areas of the closing arms 370, 372 slide into the channels 352 and 354 until the coupling recesses 392, 394 are at the level of the coupling pins 348 and 350. Hydraulic pressure is then applied to cylinder 384, so that the piston rod 386 advances and thereby moves the spread rollers 388, 390. During this process, the spread rollers 388, 390 contact the opposite drive surfaces 396, 398 of the drive arms 374, 376 and cause the closing levers 362 and 364 to pivot about pins 366 and 368. The result is that the closing arms 370, 372 approach each other and engage the coupling pins 348, 350, and position them within the outside with the coupling recesses 392, 394.

As the piston rod 386 advances further, the drive arms 374, 376 are spread further apart, so that the opposing compression jaws 306, 310 move toward each other and the closing gap 316 is reduced. Because press surfaces 307, 309, and 311 are integral with the associated jaws, they move with the jaws and not relative thereto. The press ring 302 is constricted in this manner until the final shaping position shown in FIG. 14 is reached, in which the left and right compression jaws 306, 310 have made contact and thus their end faces 359 and 361 are engaged. During this compression closing process, the annular ring 326 and the immediately adjacent area of the cylinder section 322 of the press fitting 320 are plastically deformed radially toward the inside, whereby the end area of the pipe 318 is constricted radially toward the inside as well. Due to the shape of the inside surfaces 307, 309, and 311 of the compression jaws 306, 308, and 310, respectively, the result is a hexagon shape. In this manner, the press fitting 320 and the end area of the pipe 318 are connected in a tight and close manner.

Figure 17:
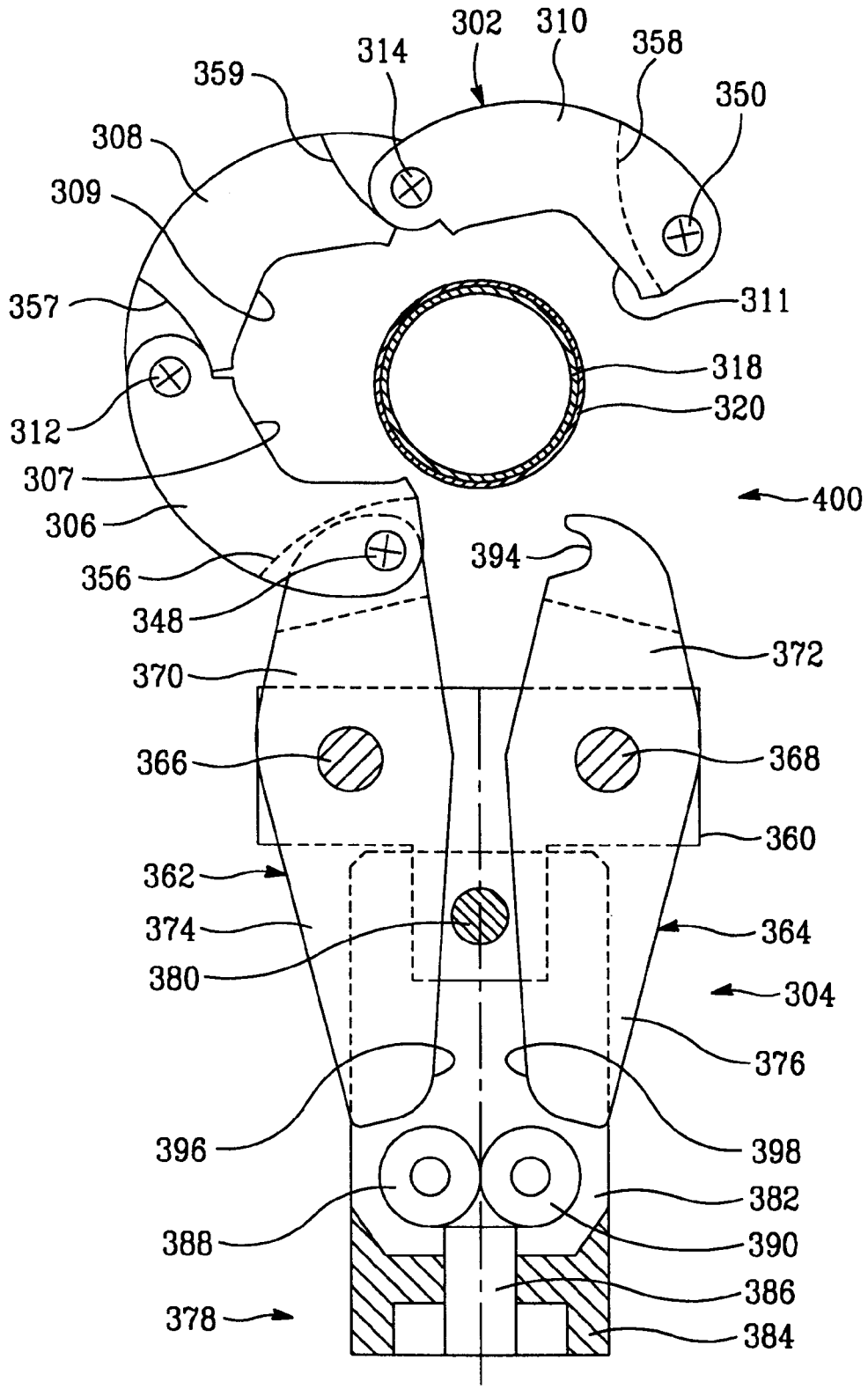
FIG. 17 shows a side view of another pressing device with a compression molding die and a closing device linked on one side in the starting position.

FIG. 17 shows a pressing device 400 which is slightly modified with regard to the pressing device 300 of FIGS. 13 through 16. Its basic structure is identical to that of pressing device 300, so that corresponding parts in FIG. 17 have the same reference numbers. Please refer to the description of pressing device 300 for the description of these parts. The pressing device 400 has the following modifications, however.

The closing device 304 has a closing lever 362 on its left side whose closing arm 370 does not have a coupling recess, but instead completely encloses the coupling pin 348 in the area of the fork. Compression jaw 306 may pivot freely about pin 348. This is how the closing device 304 is connected with the press ring 302 in a pivoting manner. The pin 350 of the compression jaw 310 is remote from coupling recess 394.

For the pressing process, the press ring 302 is placed around the press fitting 320.

This is continued until the press ring 302 is approximately in the position which is shown in FIG. 13, and until the forked area of the right closing lever 364 can recess into the channel area 358 of the compression jaw 310. Once the coupling recess 394 is on the level of the coupling pin 350, then the press ring 302 can be constricted as described for pressing device 300, that is, hydraulic pressure is applied to hydraulic cylinder 384 so that the piston rod 386 thereby moves the spread rollers 388, 390 which contact the opposite drive surfaces 396, 398, thus spreading the drive arms 374, 376. In this manner, the compression jaws 306, 308 are gradually brought into the final pressing position. In this position, the pressing device 400 is identical to pressing device 300 shown in FIG. 14, with the exception of the above discrepancy with regard to the shape of the upper end area of the closing arm 370.

Another deviation from the pressing device 300 according to FIG. 13 is the fact that the connecting pin 380 of the drive device 304 can easily be removed. This makes it possible to separate the drive device 378 from the lever bearing plate 360. This simplifies the operation of placing the press ring 302 around the press fitting 320, because the is weight of the driving device 378 is no longer existent. Once the press ring 302 is fitted around the press fitting 320 and once the coupling recess 394 has engaged the coupling pin 350, the drive device 378 can be attached to the lever bearing plate 360 by connecting pin 380.

Figure 18:
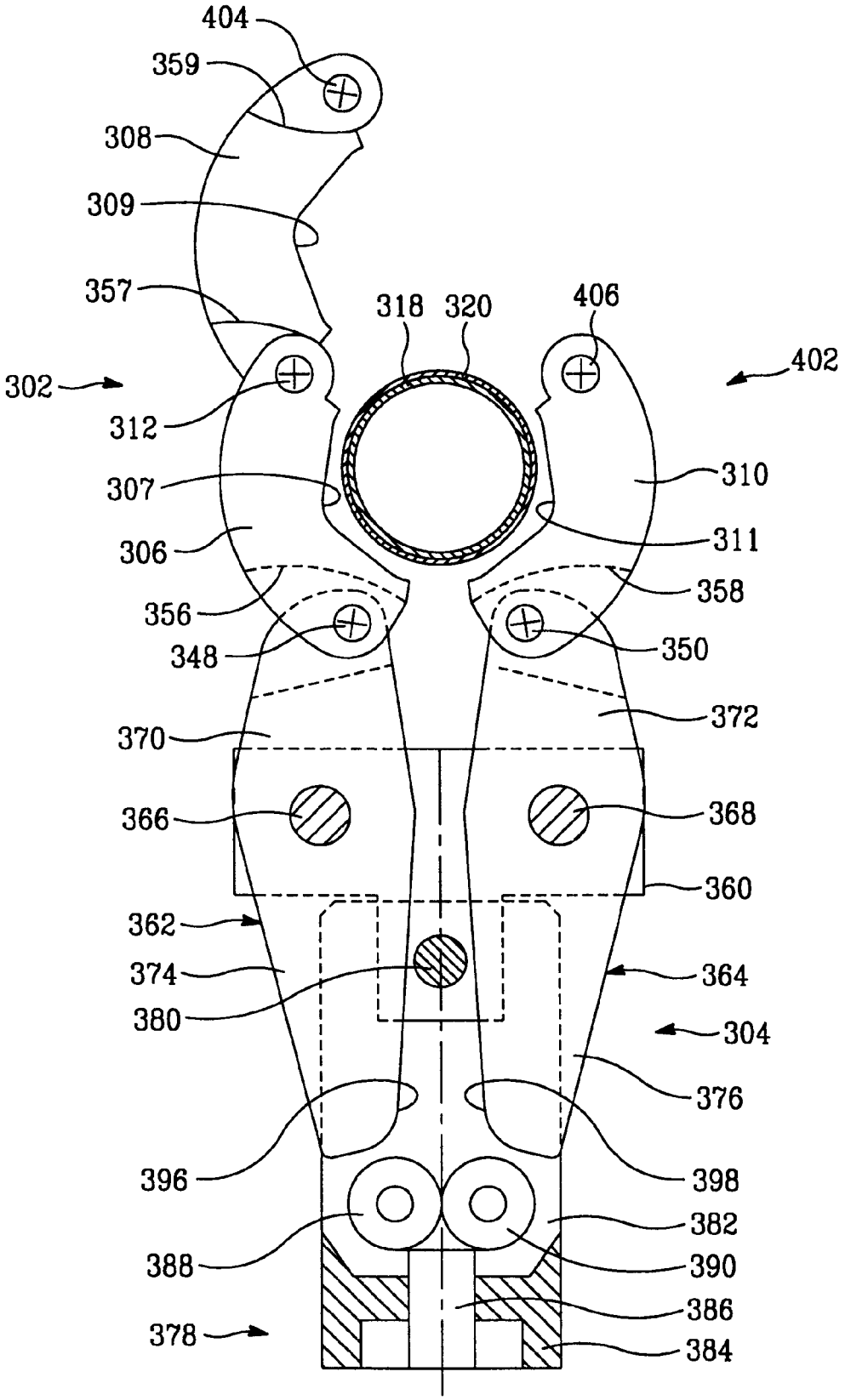
FIG. 18 shows a side view of another pressing device with a compression molding die and a closing device linked on both sides in the starting position.

FIG. 18 shows the pressing device 402, another modification of the pressing device 300. Again, the basic structure of pressing device 402 is identical to that of pressing device 300. Thus, the same reference numbers are used for the corresponding parts and the pressing device 300 is referred to for the description of these parts. The pressing device 402 is different from pressing devices 300, 400 in the following aspects.

Compared to pressing device 400, the upper area of the right closing arm 372 has the same structure as the closing arm 370 in pressing device 400. That is, both fork-shaped end areas of the closing arm 370, 372 completely enclose the respective coupling pin 348, 350. The compression jaws 306, 310 are linked to the closing levers 362, 364 via the coupling pins 348, 350, and may rotate about those pins.

In order to ensure that the press ring 302 can be placed over the press fitting 320 and the end area of the pipe 318, the hinge pin 314 can be removed. In this manner, it is possible to separate the upper compression jaw 308 from the right compression jaw 310 and to pivot it up and to the outside, so that the press ring 302 is open and can be placed around the press fitting 320 as can be seen in FIG. 18. Then, the upper compression jaw 308 is pivoted into the direction of the right compression jaw 310 again until the openings 404, 406 intended for the hinge pins 314 are aligned. After the hinge pin 314 is placed, the pressing process can start in the same manner as described for the pressing devices 300, 400. The final pressing position of the pressing device 402 is identical to the final pressing position of the pressing device 300 shown in FIG. 14.

Figure 19:
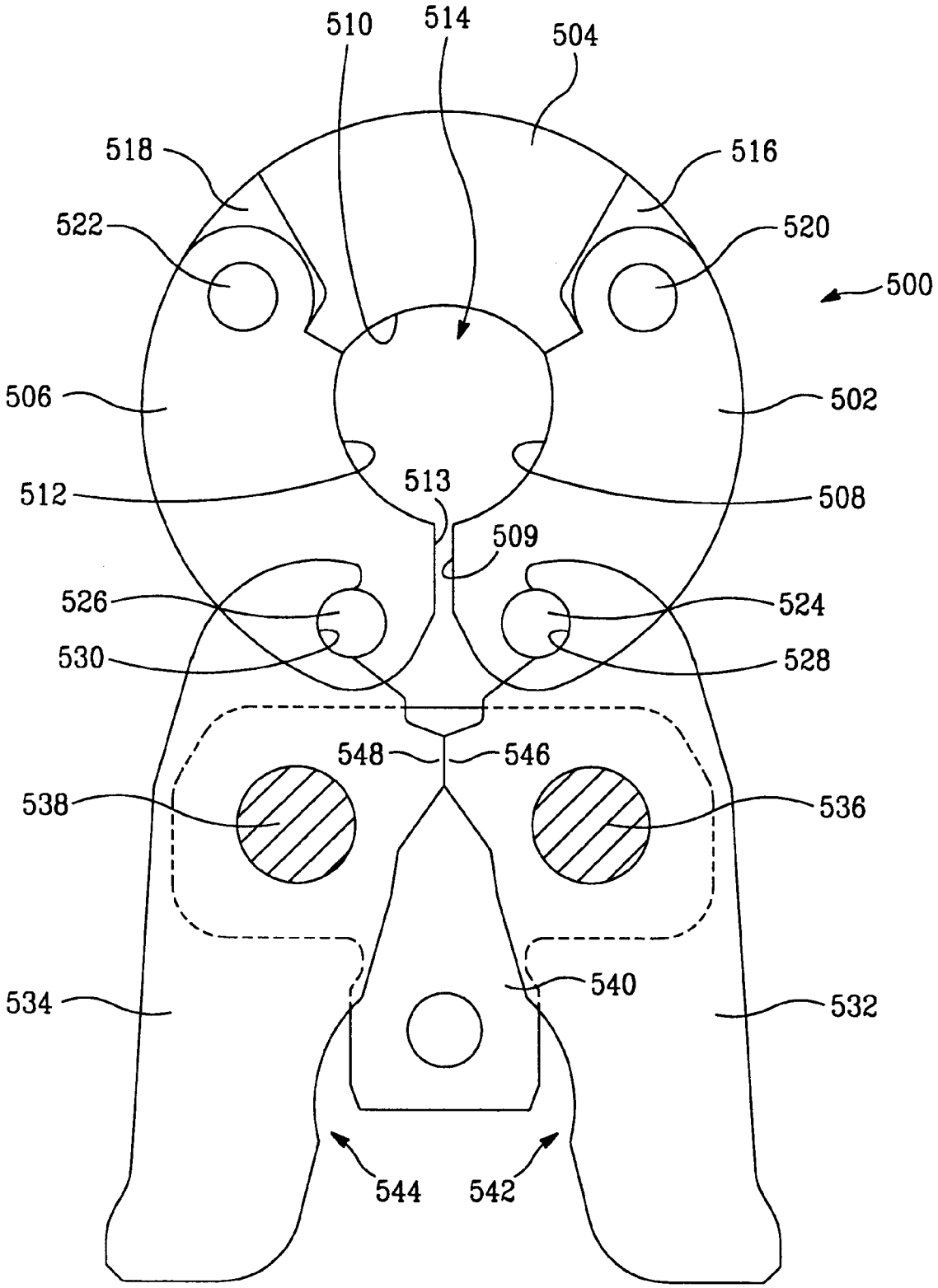
FIG. 19 is an elevational view, with portions shown in phantom, of another embodiment of the invention.

FIG. 19 discloses press device 500 having a press ring provided by pivotally interconnected press jaws 502, 504, and 506. The press jaws have cooperating press surfaces 508, 510, and 512, respectively, that form, when in the closed orientation of FIG. 19, an essentially closed pressing area 514. The press jaws may have separate pressing surfaces that are fixed or slidable, or the press surfaces may be integral as shown. Pressing area 514 may have essentially any closed shape, and need not be circular. Preferably press jaw 504 has recessed portions 516 and 518 at its lateral ends, in which pins 520 and 522 are secured for pivotally receiving press jaws 502 and 506, respectively. Recessed portions 516 and 518 may be configured to act as tongues received between opposed grooves formed by press jaws 502 and 504, or press jaws 502 and 504 may rest against the recessed portions, in order to provide support for the press jaws. The support, during pivoting motion between the closed position of FIG. 19, and the open position (not shown) in which pieces to be pressed may be placed within press area 514 or already pressed pieces removed therefrom, prevents the press tool 500 from being deformed during pressing operation.

Lugs 524 and 526 are carried by press jaws 502 and 506, respectively, and preferably extend from opposite major surfaces thereof Lugs 524 and 526 are received within arcuate catches 528 and 530 at the distal ends of operating levers 532 and 534, respectively. Levers 532 and 534 pivot about pins 536 and 538, respectively, carried by support block 540. T-shaped lever bearing plate 540 cooperates with a drive unit, such as an hydraulic actuator, pneumatic actuator, or electric actuator, for causing levers 532 and 534 to pivot in order to shift press device 500 between the closed position and the open position. The drive unit may be such as disclosed in FIGS. 17 and 18, and which correspondingly operates on the T-shaped lever bearing plate 540.

Each of the operating levers 532 and 534 has an interior contoured surface 542 and 544, respectively. The operating levers and their interior surfaces may be identical, in order to minimize manufacturing costs and to increase the ease of assembly. Each of the interior surfaces 542 and 544 has a protruding apex 546 and 548, respectively. The apexes 546 and 548 engage when the press device 500 is in the closed position of FIG. 19, and thus act as stops preventing overtravel of the operating levers 532 and 534. Each of the apexes 546 and 548 is formed as a surface having a not insignificant thickness, in order to provide strength during closing of the press jaws 502, 504, and 506 by the action of the operating levers 532 and 534.

The cooperating stopping action provided by the abutting surfaces of apexes 546 and 548 is similar to the stopping action achieved by engagement of lateral end surfaces of the pressing jaws and lateral end surfaces of the press ring components. Because of the positive stopping action that is achieved by engagement of the respective stopping surfaces, then a high strength drive unit may be utilized in order to maximize the connection between the tubular coupling and the pipe end components forming the workpieces. Additionally, a high-speed drive unit may be utilized, because engagement of the stopping surfaces assures that a highly accurate drive control mechanism need not be utilized. Rather, a relatively simple control mechanism is provided by the stopping surfaces, but yet one that assures that the drive unit may remain actuated until the pressing operation is completed. Additionally, in part because of the precise stopping action achieved, it in some instances is permissible that edge surfaces 509 and 513 not be in engagement when the press ring is in the closed orientation of FIG. 19.

While I prefer that the stop surfaces be provided by cooperating edge or end surfaces of the press jaws, or of the press ring components, or of the operating levers, those skilled in the art will appreciate that the precise positioning of the surfaces is a function of the particular press tool. It is important merely that the cooperating stop surfaces be located somewhere between the press ring and the drive unit. Moreover, the stop surfaces must be juxtaposed for engagement, so that one stop surface faces another stop surface and these surfaces may thus engage to stop the press tool precisely as desired. Engagement of the stop surfaces may be used as a control mechanism, triggering shifting of the drive unit into the opposite direction in order to maximize efficiency of operation.

While this invention has been described as having a preferred design, it is understood that the it is capable of further modifications, uses, and/or adaptations which follow in general the principle of the invention and includes such departures from the present disclosure as come within known or customary practice in the art to which the invention pertains and that may be applied to the central features hereinbefore set forth and fall within the scope of the limits of the appended claims.

I claim:

1. A pressing device, comprising:

a) a press ring including at least three articulatably interconnected at respective adjacent circumferential ends compression jaws, said press ring having a first open non-circular configuration permitting tubular workpieces to be positioned within said press ring and a second closed circular encircling configuration for compressing one workpiece about another, and two of said compression jaws having a coupling element;

b) a closing device for operable connection with said press ring for shifting said press ring between said first and second configurations;

c) at least one drive device operably engageable with said pressing device for causing said closing device to shift said press ring between said first and second configurations; and d) first and second abuttable faces, said abuttable faces engage when said press ring is in said second configuration and thereby prevent overtravel of said compression jaws.

2. The device of claim 1, wherein:

said abuttable faces are carried on juxtaposed members.

3. The device of claim 2, wherein:

each of said abuttable faces comprises an apex.

4. The device of claim 2, wherein:

a) each of said abuttable faces is carried by one of said compression jaws and levers forming a part of said drive device.

5. The device of claim 1, wherein:

a) each of said compression jaws contains a first end portion and second end portion, the first and second compression jaws being pivotally secured at said first end portions to said third compression jaw, and said second end portions of said first and second compression jaws carry said coupling element.

6. The device of claim 5, wherein:

a) said third compression jaw includes a first end portion and a second end portion, said first compression jaw being pivotally secured to said third jaw first end portion and said second compression jaw being pivotally secured to said third jaw second end portion.

7. The device of claim 6, wherein:

a) said coupling elements are drive bolts, each said drive bolt extends generally perpendicular to the associated jaw.

8. The device of claim 1, wherein:

a) each of said closing levers includes a hook-shaped end portion, each hook-shaped end portion engageable with a coupling element.

9. The device of claim 1, wherein:

a) said closing device is detachable from said press ring.

10. The device of claim 1, wherein:

a) said closing device includes first and second closing levers, said first closing lever is pivotally secured with a first coupling element and said second closing lever is detachable from a second coupling element.

11. The device of claim 1, wherein:

a) said closing device includes first and second closing levers, each of said closing levers is pivotally secured to a coupling element, and said third compression jaw is detachable from an adjacent one of said compression jaws.

12. The device of claim 8, wherein:

a) each of said coupling elements contains channel areas for receipt of said hook-shaped end portions.

13. The device of claim 1, wherein:

a) each of said compression jaws has an integral compression surface.

14. The device of claim 1, wherein:

a) said compression surfaces cooperate and define a hexagonal shape when in said second configuration.

15. The device of claim 1, wherein:

a) said drive device includes a pair of adjacent rollers, said rollers engageable with said closing levers for causing pivoting thereof.

16. The device of claim 1, wherein:

a) said drive device is connected to a lever bearing plate.

17. The device of claim 16, wherein:

a) said drive device is detachable from said lever bearing plate.

18. The device of claim 1, wherein:

a) said drive device is one of an hydraulic and pneumatic cylinder.

19. The device of claim 1, wherein:

a) said drive device includes an electric motor.

20. The device of claim 2, wherein:

a) each compression jaw is connected to an adjacent compression jaw through a pivot pin, said pivot pins being equiangularly disposed about said ring.

21. The device of claim 20, wherein:

a) said coupling elements are spaced apart when said ring is in said second closed configuration.

22. Combination of a compression tool and a coupling workpiece and a pipe end, the compression tool comprising more than two compression jaws connected in an articulatable manner at respective adjacent circumferential ends for forming a press ring having a first open non-circular configuration and a second closed circular encircling configuration, the compression jaws movable substantially radially inwardly by at least one drive device, with the press ring disposable around the workpiece for allowing compression thereof during closing of the press ring to the second configuration by the drive device, characterized in that the press ring is still open in the first configuration after having been disposed around the workpiece and the pipe end and that the compression of the workpiece is caused by closing the press ring through use of the drive device.

23. Method for joining tubular workpieces, comprising a coupling device and a pipe end by plastically deforming radially the coupling piece by means of a compression tool comprising more than two compression jaws that are connected articulatably together at respective adjacent circumferential ends in order to form a press ring, and which are movable substantially radially inwardly by at least one drive device, wherein the press ring is disposed around the workpiece for compression upon closing of the press ring, comprising the steps of:

a) placing the press ring in an open first non-circular orientation around a coupling piece and a pipe end;

b) closing the compression ring to a second closed circular encircling orientation by moving the compression jaws together through use of a drive device and thereby compressing radially the coupling piece; and c) stopping closing of the press ring in the second orientation after the coupling piece has been compressed.

* * * * *